US009423711B2

(12) United States Patent
Uratani et al.

(10) Patent No.: US 9,423,711 B2
(45) Date of Patent: Aug. 23, 2016

(54) MAGNETIC TONER

(71) Applicant: CANON KABUSHIKI KAISHA, Tokyo (JP)

(72) Inventors: Kozue Uratani, Mishima (JP); Michihisa Magome, Mishima (JP); Yusuke Hasegawa, Suntou-gun (JP); Shuichi Hiroko, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 1 day.

(21) Appl. No.: 14/364,634

(22) PCT Filed: Jan. 31, 2013

(86) PCT No.: PCT/JP2013/052785

§ 371 (c)(1),
(2) Date: Jun. 11, 2014

(87) PCT Pub. No.: WO2013/115411

PCT Pub. Date: Aug. 8, 2013

(65) Prior Publication Data

US 2014/0335449 A1 Nov. 13, 2014

(30) Foreign Application Priority Data

Feb. 1, 2012 (JP) ..... 2012-019519

(51) Int. Cl.

| | |
|---|---|
| ***G03G 9/083*** | (2006.01) |
| ***G03G 9/08*** | (2006.01) |
| ***G03G 9/087*** | (2006.01) |
| ***G03G 9/097*** | (2006.01) |

(52) U.S. Cl.

CPC ..... *G03G 9/0833* (2013.01); *G03G 9/081* (2013.01); *G03G 9/0836* (2013.01); (Continued)

(58) Field of Classification Search

CPC ... G03G 9/0833; G03G 9/081; G03G 9/0836; G03G 9/08782; G03G 9/08706; G03G 9/08797; G03G 9/09708; G03G 9/09725; G03G 9/08795

See application file for complete search history.

(56) References Cited

U.S. PATENT DOCUMENTS

| | | | |
|---|---|---|---|
| 5,066,558 | A | 11/1991 | Hikake et al. |
| 5,456,990 | A | 10/1995 | Takagi et al. |
| 7,452,649 | B2 | 11/2008 | Magome et al. |
| 7,740,998 | B2 | 6/2010 | Yamazaki et al. |

FOREIGN PATENT DOCUMENTS

| | | | | |
|---|---|---|---|---|
| JP | 57-93352 | A | 6/1982 | |
| JP | 2-167561 | * | 6/1990 | ..... G03G 9/08 |

(Continued)

OTHER PUBLICATIONS

Translation of JP 08-012478 published Jun. 1990.*

(Continued)

*Primary Examiner* — Peter Vajda

(74) *Attorney, Agent, or Firm* — Fitzpatrick, Cella, Harper & Scinto

(57) ABSTRACT

A magnetic toner including: magnetic toner particles containing a binder resin, a magnetic body, and a release agent; and inorganic fine particles present on the surface of the magnetic toner particles, wherein the inorganic fine particles present on the surface of the magnetic toner particles contain metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles, wherein the magnetic toner has a coverage ratio A of the magnetic toner particles' surface by the inorganic fine particles and a coverage ratio B of the magnetic toner particles' surface by the inorganic fine particles fixed to the magnetic toner particles' surface that reside in prescribed numerical value ranges; the binder resin contains a styrene resin; the release agent contains a monoester compound or a diester compound; and the softening temperature and softening point of the magnetic toner reside in prescribed temperature ranges.

5 Claims, 10 Drawing Sheets

(52) U.S. Cl.
CPC ..... *G03G 9/08706* (2013.01); *G03G 9/08782* (2013.01); *G03G 9/08795* (2013.01); *G03G 9/08797* (2013.01); *G03G 9/09708* (2013.01); *G03G 9/09725* (2013.01)

(56) References Cited

FOREIGN PATENT DOCUMENTS

| | | | | | |
|---|---|---|---|---|---|
| JP | 2-167561 | A | | 6/1990 | |
| JP | 08-012478 | | * | 6/1990 | ..... G03G 9/08 |
| JP | 4-145448 | A | | 5/1992 | |
| JP | 5-297630 | A | | 11/1993 | |
| JP | 6-273974 | A | | 9/1994 | |
| JP | 7-199529 | A | | 8/1995 | |
| JP | 7-199539 | A | | 8/1995 | |
| JP | 10-48869 | A | | 2/1998 | |
| JP | 2002-323791 | A | | 11/2002 | |
| JP | 2004-061934 | | * | 2/2004 | ..... G03G 9/083 |
| JP | 2004-61934 | A | | 2/2004 | |
| JP | 2005-107519 | | * | 4/2005 | ..... G03G 9/083 |
| JP | 2005-107519 | A | | 4/2005 | |
| JP | 2007-065435 | | * | 3/2007 | ..... G03G 9/08 |
| JP | 2007-65435 | A | | 3/2007 | |
| JP | 2008-15248 | A | | 1/2008 | |
| JP | 2010-79312 | A | | 4/2010 | |
| JP | 2010-145549 | A | | 7/2010 | |
| JP | 2010-145553 | A | | 7/2010 | |
| JP | 2011-133675 | A | | 7/2011 | |

OTHER PUBLICATIONS

Translation of JP 2005-107519 published Apr. 2005.*
Translation of JP 2004-061934 published Feb. 2004.*
Translation of JP 2007-065435 published Mar. 2007.*
U.S. Appl. No. 14/364,068, filed Jun. 9, 2014. Applicant: Michihisa Magome, et al.
U.S. Appl. No. 14/362,380, filed Jun. 2, 2014. Applicant: Yoshitaka Suzumura, et al.
U.S. Appl. No. 14/362,377, filed Jun. 2, 2014. Applicant: Takashi Matsui, et al.
U.S. Appl. No. 14/364,633, filed Jun. 11, 2014. Applicant: Atsuhiko Ohmori, et al.
U.S. Appl. No. 14/364,636, filed Jun. 11, 2014. Applicant: Tomohisa Sano, et al.
U.S. Appl. No. 14/364,640, filed Jun. 11, 2014. Applicant: Shotaro, Nomura, et al.
U.S. Appl. No. 14/364,638, filed Jun. 11, 2014. Applicant: Keisuke Tanaka, et al.
U.S. Appl. No. 14/364,067, filed Jun. 9, 2014. Applicant: Yusuke Hasegawa, et al.
U.S. Appl. No. 14/364,065, filed Jun. 9, 2014. Applicant: Shuichi Hiroko, et al.
PCT International Search Report and Written Opinion of the International Searching Authority, International Application No. PCT/JP2013/052785, Mailing Date Mar. 19, 2013.

* cited by examiner

MAGNETIC TONER

TECHNICAL FIELD

The present invention relates to a magnetic toner that is used in recording methods that use, for example, an electrophotographic system.

BACKGROUND ART

Printers and copiers have in recent years been making the transition from analog to digital, and, while there is strong demand for an excellent latent image reproducibility and a high resolution, there is at the same time strong demand for greater energy savings and downsizing, particularly with regard to printers.

Simplifying the fixing unit and developing assembly (cartridge) is effective for getting greater energy savings to coexist in balance with downsizing. Film fixing is an example of a fixing unit that facilitates simplification of the heat source and structure. In this fixing method, fixing is carried out while bringing the recording medium into close contact with the heating element through the intermediary of a fixing film, and as a result an excellent thermal efficiency is obtained during melt adhesion of the toner on the recording medium.

However, in order to achieve even more substantial energy savings, the development is required of systems and materials that enable a lowering of the amount of heat from the heating element and fixing at low temperatures. During fixing in film fixing methods the film and recording medium are brought into close contact by a contacting pressure member, but since a strong pressure is not applied, the fixing characteristics in particular of the toner must be substantially improved. That is, the low-temperature fixability of the toner must be improved.

As a general matter, efforts to improve the low-temperature fixability frequently also result in a lowering of the storage stability of the toner in a high-temperature environment. For example, when a toner composition that softens at lower temperatures is used, the toner may undergo blocking in a high-temperature environment and a stable image density may not be obtained. It has thus been quite difficult to have the low-temperature fixability coexist in balance with the storage stability.

Controlling the properties of the binder resin in the toner particle core is known as a technique for improving the low-temperature fixability. In Patent Literature 1, the ratio between the high-molecular weight component and low-molecular weight component in the toner is controlled and the flow tester-measured softening temperature of the toner and softening temperature of the binder resin are controlled. However, when the amount of high-molecular weight component is controlled in a broad range of from at least 15% to not more than 50 mass % and the softening temperature of the toner is not more than 150° C., fixing at low temperature•light pressure is thought to be strongly impaired since the controlled temperature range is a high temperature region. Otherwise, the molecular weight of the binder resin, the softening temperature of the toner, the melting temperature of the toner by the ½ method (referred to below as the "softening point"), and the glass-transition temperature of the toner are controlled in Patent Literature 2. However, issues remain with high-speed fixing using a hydrocarbon wax with a high melting point as the release agent, and, in addition, since the softening temperature is low, there is room for improvement from the perspective of a balanced coexistence with the storage stability of the toner.

On the other hand, the use of an external additive to inhibit blocking is known as a technique for improving the storage stability. The exposure of the toner particle core can be suppressed, and the blocking resistance can then be improved, by covering the toner particle with an external additive. However, external additives impede fixing because they interfere with thermal conduction to the toner particle, and as a consequence it is quite difficult to bring about a high degree of coexistence between the low-temperature fixability and the storage stability just by coverage with an external additive alone.

Patent Literature 3 states that—by using two types of silica fine particles (number-average primary particle diameter is at least 25 nm, and at least 45 nm) with different particle diameters as the external additive—the storage stability can be maintained even at a low coverage ratio of the toner particle by the silica fine particles and the impediment to fixing can also be suppressed. However, no specific evaluation of the fixing performance is mentioned and the effect on the fixing performance is thus unclear; in addition, due to the low coverage ratio, questions remain as to whether the storage stability can be maintained when an easily softened toner particle core is used.

CITATION LIST

Patent Literature

[PTL 1] Japanese Patent Application Publication No. 07-199529

[PTL 2] Japanese Patent Application Publication No. 05-297630

[PTL 3] Japanese Patent Application Publication No. 2011-133675

SUMMARY OF INVENTION

Technical Problems

The present invention provides a magnetic toner that can solve the problems identified above. That is, the present invention provides a magnetic toner that achieves a high degree of low-temperature fixability and the storage stability at the same time.

Solution to Problem

The present inventors discovered that the problems can be solved by specifying the relationship between the coverage ratio A of the magnetic toner particles' surface by the inorganic fine particles and the coverage ratio B of the magnetic toner particles' surface by inorganic fine particles that are fixed to the magnetic toner particles' surface, and by specifying the release agent and binder resin that constitute the magnetic toner particle and the softening temperature and softening point of the magnetic toner. The present invention was achieved based on this discovery.

Thus, the present invention is as follows:

a magnetic toner including: magnetic toner particles containing a binder resin, a magnetic body, and a release agent; and inorganic fine particles present on the surface of the magnetic toner particles, wherein;

the inorganic fine particles present on the surface of the magnetic toner particles contain metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles, wherein;

when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed to the magnetic toner particles' surface, the magnetic toner has a coverage ratio A of at least 45.0% and not more than 70.0% and a ratio [coverage ratio B/coverage ratio A] of the coverage ratio B to the coverage ratio A of at least 0.50 and not more than 0.85, wherein the binder resin contains a styrene resin, the release agent contains a monoester compound or a diester compound, and wherein in measurement of the magnetic toner with a constant-load extrusion-type capillary rheometer, a softening temperature (Ts) is from at least 60.0° C. to not more than 75.0° C. and a softening point (Tm) is from at least 120.0° C. to not more than 150.0° C.

Advantageous Effects of Invention

The present invention can provide a magnetic toner that exhibits an excellent fixing performance in low-temperature, light-pressure fixing unit structures and that gives a stable image density even when having been submitted to storage in a high-temperature environment.

DESCRIPTION OF EMBODIMENTS

Figure 1:
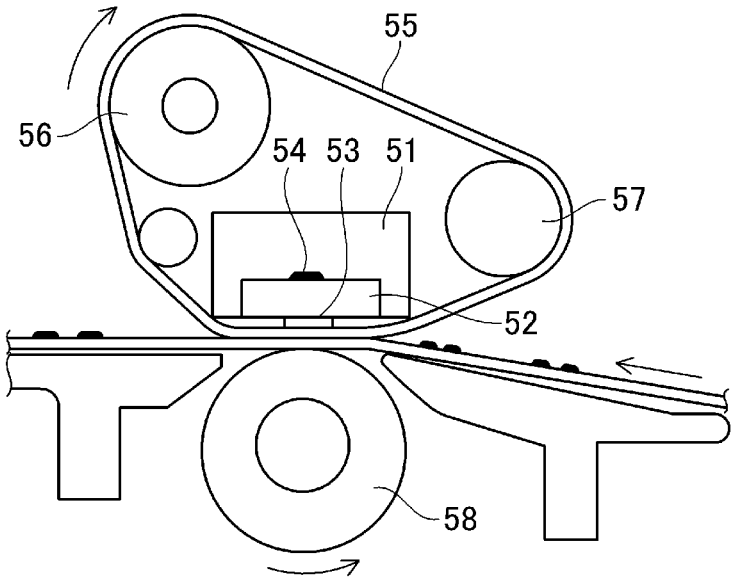
FIG. 1 is a schematic diagram that shows an example of a fixing unit.

The magnetic toner of the present invention (also referred to in the following simply as toner) is a magnetic toner including: magnetic toner particles containing a binder resin, a magnetic body, and a release agent; and inorganic fine particles present on the surface of the magnetic toner particles, wherein;

the inorganic fine particles present on the surface of the magnetic toner particles contain metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles, wherein;

when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed to the magnetic toner particles' surface, the magnetic toner has a coverage ratio A of at least 45.0% and not more than 70.0% and a ratio [coverage ratio B/coverage ratio A] of the coverage ratio B to the coverage ratio A of at least 0.50 and not more than 0.85, wherein the binder resin contains a styrene resin, the release agent contains a monoester compound or a diester compound, and wherein in measurement of the magnetic toner with a constant-load extrusion-type capillary rheometer, a softening temperature (Ts) is from at least 60.0° C. to not more than 75.0° C. and a softening point (Tm) is from at least 120.0° C. to not more than 150.0° C.

First, a schematic diagram of a fixing unit related to the present invention is shown in FIG. 1. However, the magnetic toner of the present invention is not limited to use in the fixing unit structure of FIG. 1.

In the fixing step, heat generated by a heating element (53) is transferred across a heat-resistant film (55) and promotes toner melting•deformation. In addition, pressure is applied by a support roller (58) and the melted toner is fixed to a recording medium, e.g., paper. In order to bring about stable fixing of the toner to the recording medium when the amount of heat from the heating element is lowered in pursuit of energy savings, the heat must be efficiently transferred to the toner on the lower layer (recording medium side) and the toner itself must rapidly melt and its adhesiveness to the recording medium must be raised.

The binder resin in the magnetic toner of the present invention contains a styrene resin and the release agent in the magnetic toner of the present invention contains a monoester compound or a diester compound. The monoester compound and diester compound are favorably compatible with the styrene resin and soften the binder resin; in addition, because they also have a high sharp melt property on their own, the monoester compound or diester compound present without undergoing miscibilization rapidly melts in the fixing zone. At this time, the melted release agent plasticizes the binder resin and raises the particle-to-particle adhesiveness and can eliminate interparticle gaps (air layer). The result is an excellent thermal conductivity, which is very favorable for low-temperature fixing. Specific examples of favorable release agents are provided below, but, for example, hydrocarbon-type release agents, due to a poor sharp melt property, do not provide an improvement in the low-temperature fixability.

In addition, it is crucial that the softening temperature (Ts) of the magnetic toner, as measured using a constant-load extrusion-type capillary rheometer, be from at least 60.0° C. to not more than 75.0° C. and that the softening point (Tm) be from at least 120° C. to not more than 150° C. Preferably the softening temperature (Ts) is from at least 65.0° C. to not more than 75.0° C. and the softening point (Tm) is from at least 125.0° C. to not more than 140.0° C. The softening temperature (Ts) and the softening point (Tm) are both indicators of the ease of melting of the magnetic toner, and it is crucial in particular that the softening temperature (Ts) of the magnetic toner be controlled into the range indicated above when, in a low-temperature environment unfavorable for the heating of the fixing unit, the amount of heat from the heating element is also lowered. In the case of a low fixing temperature, the temperature of the recording medium in the fixing zone formed by the heat-resistant film and the support roller may be not more than 100° C. in the case of paper. Exercising control whereby the magnetic toner softens even at such temperatures and the particles are rapidly adhered by the pressure is favorable for fixing because the gaps between toner particles are then eliminated and heat conduction can be efficiently carried out.

The ease of softening of the magnetic toner at such low temperatures can be controlled to a high degree by the softening temperature (Ts). When the softening temperature (Ts) is not more than 75.0° C., the magnetic toner is easily melted and an excellent fixing is performed even under conditions hostile to fixing, such as those described above. However, while a softening temperature (Ts) of less than 60.0° C. is preferred for low-temperature fixing, it is unfavorable from the standpoint of storage stability.

The softening temperature (Ts) can be adjusted into the range indicated above using the composition of the release agent and the content of low molecular weight polymer in the binder resin. For example, when a monoester compound or diester compound is used for the release agent, a portion of the release agent miscibilizes with the styrene resin used in the present invention and softening of the resin is promoted and as a consequence the softening temperature (Ts) can be lowered. Moreover, the softening temperature (Ts) can be adjusted downward by having low molecular weight polymer make up a large proportion of the binder resin and by lowering the peak molecular weight of the low molecular weight polymer; however, as noted above, a softening temperature (Ts) below 60.0° C. is unfavorable due to the deterioration in the storage stability.

The magnetic toner of the present invention may contain high molecular weight polymer, but, because a high molecular weight polymer will have a high melting temperature, and depending on the fixing conditions, adhesion to the recording medium may not occur in the absence of melting and particle aggregates may form and remain and heat conduction may then be impeded. As a consequence, the content of high molecular weight polymer in the binder resin must be adjusted in order to control the softening point (Tm) of the magnetic toner to from at least 120.0° C. to not more than 150.0° C. When the softening point (Tm) exceeds 150.0° C., melting of the magnetic toner is impeded and good-quality fixing is not performed. When, on the other hand, the softening point (Tm) is less than 120.0° C., the elasticity in the high temperature zone declines and hot offset is produced.

With regard to the state of attachment of the inorganic fine particles, and letting the coverage ratio A be the coverage ratio of the magnetic toner particles' surface by the inorganic fine particles, it is crucial that the magnetic toner of the present invention have a coverage ratio A of from at least 45.0% to not more than 70.0%. This coverage ratio A is preferably from at least 45.0% to not more than 65.0%.

The magnetic toner particle of the present invention exhibits an excellent low-temperature fixability, but, in order to bring about a high degree of coexistence between the low-temperature fixability and the storage stability, i.e., the blocking resistance in a high-temperature environment, it is essential to control the state of attachment of the inorganic fine particles. By having the coverage ratio A be at least 45.0%, exposure of the magnetic toner particle core is suppressed and the storage stability in a high-temperature environment can then be improved. On the other hand, the inorganic fine particles must be externally added in large amounts in order to bring the coverage ratio A above 70.0%. Even if an external addition method could be devised in such a case, the efficiency of heat transfer during fixing will be degraded by the inorganic fine particles that are released from the magnetic toner particles and the low-temperature fixability will then be degraded.

In addition, it was found that having the coverage ratio A be from at least 45.0% to not more than 70.0% also has an effect on the low-temperature fixability in addition to being able to improve the storage stability as discussed above. This is due to the generation of a bearing effect by the inorganic fine particles and to a lowering—due to a lowering of the van der Waals force—of the aggregative force between the magnetic toners and the attachment force to apparatus members. As a consequence of these, the magnetic toner that has been developed onto the electrostatic latent image-bearing member within the developing assembly resides in a loosened state in the absence of aggregation and due to this assumes a state approximating a closest packed structure. In addition, the attachment force to the electrostatic latent image-bearing member is also reduced during transfer of the magnetic toner to the recording medium, e.g., paper, from the electrostatic latent image-bearing member and an excellent transferability is exhibited as a consequence. As a result, an excellent thermal conductivity is exhibited in the fixing zone because the surface of the unfixed image is smooth and because the magnetic toner is present in a state approximating a closest packed structure. It is thought that this greatly contributes to improving the low-temperature fixability.

The inorganic fine particles represented by the coverage ratio A include the inorganic fine particles fixed to the magnetic toner particle surface and also the inorganic fine particles that are present in its upper layer and that have a relatively high degree of freedom. Here, the influence of the inorganic fine particles that can be present between magnetic toner particles and between the magnetic toner and the various apparatus members is thought to be a reason for the reduction in the aggregative force between the magnetic toners and for the reduction in the attachment force with apparatus members.

First, the van der Waals force (F) produced between a flat plate and a particle is represented by the following equation.

$$F=H\times D/(12Z^2)$$

Here, H is Hamaker's constant, D is the diameter of the particle, and Z is the distance between the particle and the flat plate.

With respect to Z, it is generally held that an attractive force operates at large distances and a repulsive force operates at very small distances, and Z is treated as a constant since it is unrelated to the state of the magnetic toner particle surface.

According to the preceding equation, the van der Waals force (F) is proportional to the diameter of the particle in contact with the flat plate. When this is applied to the magnetic toner surface, the van der Waals force (F) is smaller for an inorganic fine particle, with its smaller particle size, in contact with the flat plate than for a magnetic toner particle in contact with the flat plate. That is, the van der Waals force is smaller for the case of contact through the intermediary of the inorganic fine particles provided as an external additive than for the case of direct contact between the magnetic toner particle and fixing film.

Furthermore, the electrostatic force can be regarded as a reflection force. It is known that a reflection force is directly proportional to the square of the particle charge (q) and is inversely proportional to the square of the distance.

In the case of the charging of a magnetic toner, it is the surface of the magnetic toner particle and not the inorganic fine particles that bear the charge. Due to this, the reflection force declines as the distance between the surface of the magnetic toner particle and the flat plate (here, the fixing film) grows larger.

That is, when, in the case of the magnetic toner surface, the magnetic toner particle comes into contact with the flat plate through the intermediary of the inorganic fine particles, a distance is set up between the flat plate and the surface of the magnetic toner particle and the reflection force is lowered as a result.

As described in the preceding, the van der Waals force and reflection force produced between the magnetic toner and the fixing film are reduced by having inorganic fine particles be present at the magnetic toner particle surface and having the magnetic toner come into contact with the fixing film with the inorganic fine particles interposed therebetween. That is, the attachment force between the magnetic toner and the fixing film is reduced.

Whether the magnetic toner particle directly contacts the fixing film or is in contact therewith through the intermediary of the inorganic fine particles, depends on the amount of inorganic fine particles coating the magnetic toner particle surface, i.e., on the coverage ratio by the inorganic fine particles.

It is thought that the opportunity for direct contact between the magnetic toner particles and the fixing film is diminished at a high coverage ratio by the inorganic fine particles, which makes it more difficult for the magnetic toner to stick to the fixing film. On the other hand, the magnetic toner readily sticks to the fixing film at a low coverage ratio by the inorganic fine particles and is prone to exhibits a lower release property from the fixing film.

The coverage ratio by the inorganic fine particles can be calculated—making the assumption that the inorganic fine particles and the magnetic toner have a spherical shape—using the equation. However, there are also many instances in which the inorganic fine particles and/or the magnetic toner do not have a spherical shape, and in addition the inorganic fine particles may also be present in an aggregated state on the toner particle surface. As a consequence, the coverage ratio derived using the indicated technique does not pertain to the present invention.

The present inventors therefore carried out observation of the magnetic toner surface with the scanning electron microscope (SEM) and determined the coverage ratio for the actual coverage of the magnetic toner particle surface by the inorganic fine particles.

Figure 2:
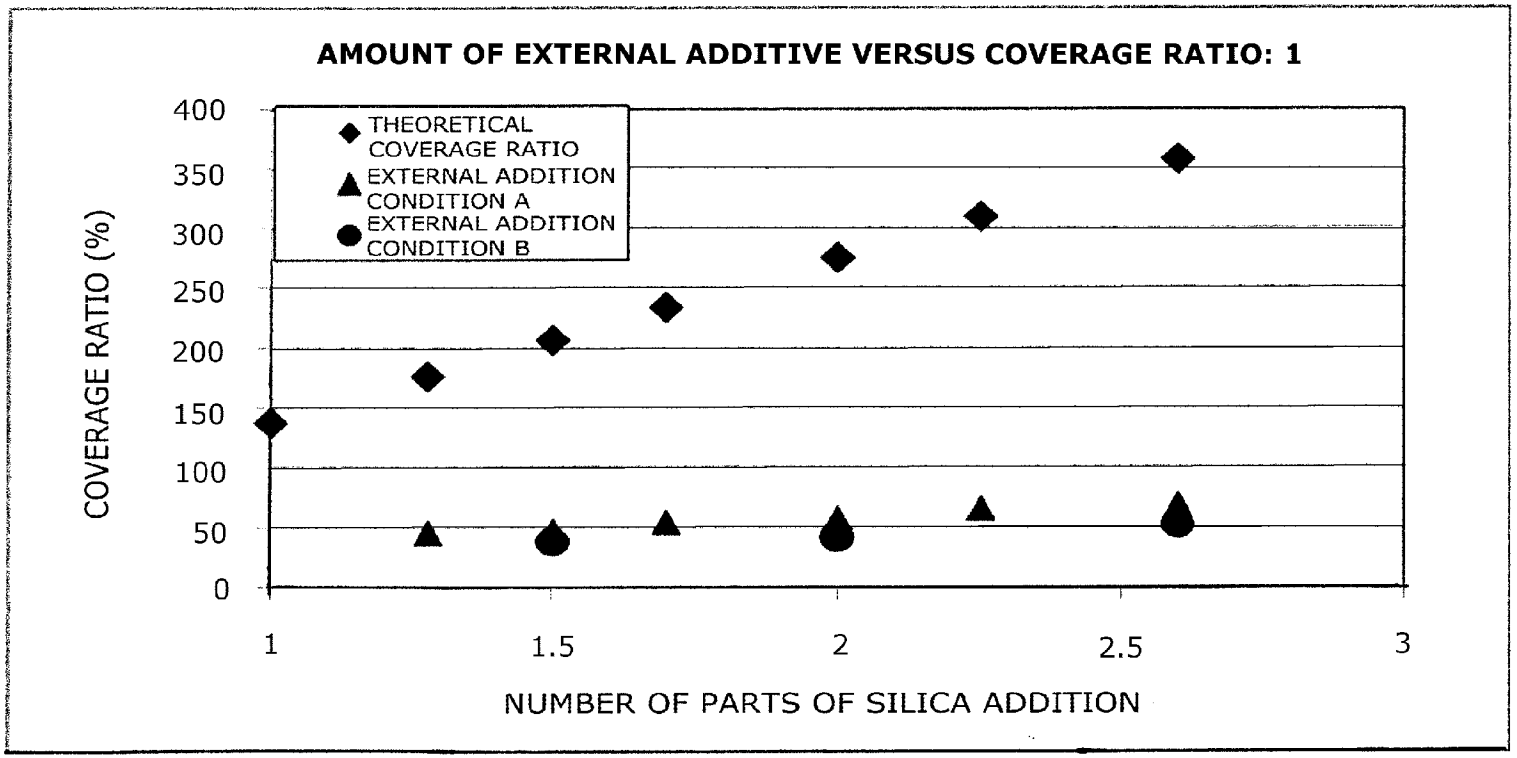
FIG. 2 is a diagram that shows an example of the relationship between the number of parts of silica addition and the coverage ratio.
Figure 3:
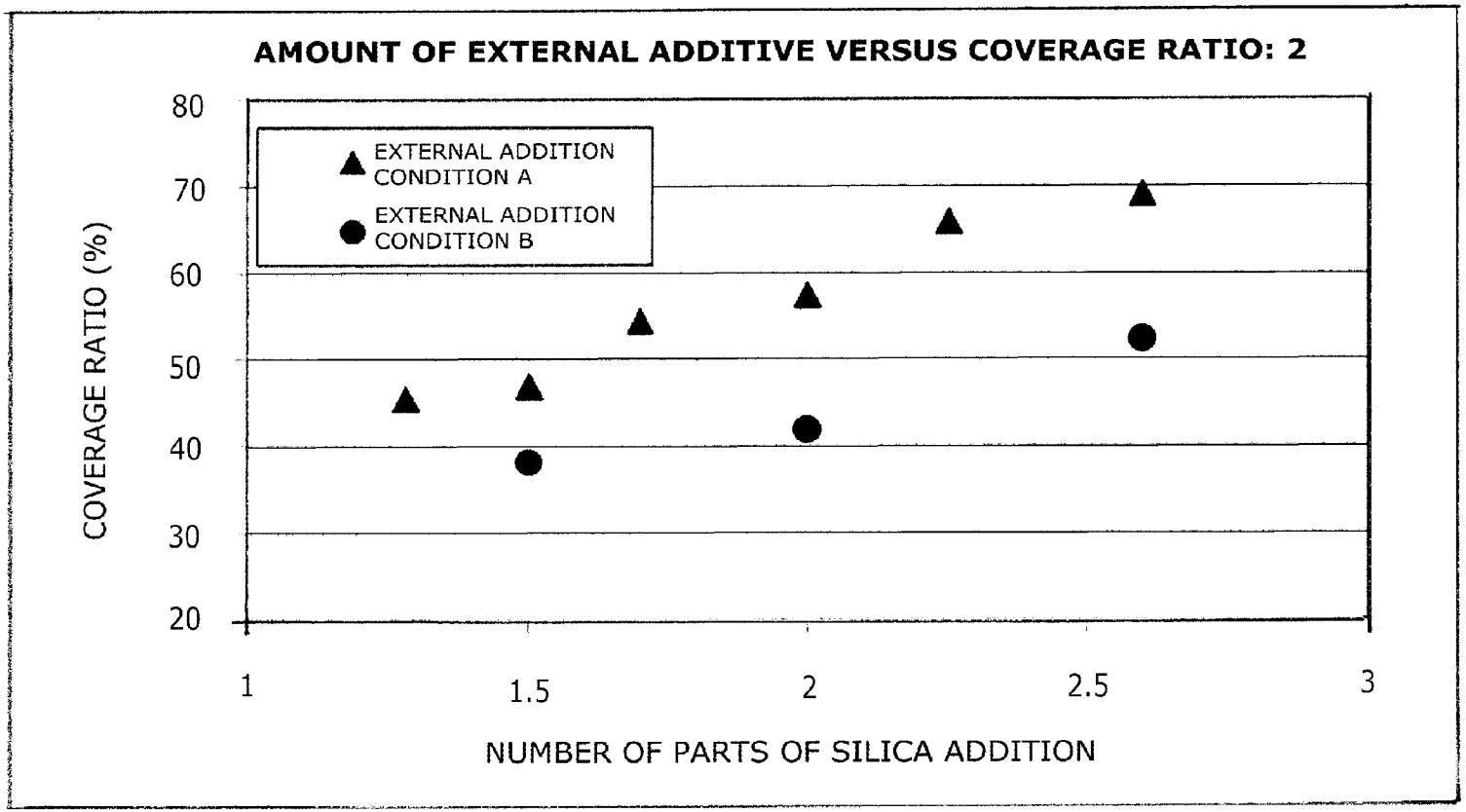
FIG. 3 is a diagram that shows an example of the relationship between the number of parts of silica addition and the coverage ratio.

As one example, the theoretical coverage ratio and the actual coverage ratio were determined for mixtures prepared by adding different amounts of silica fine particles (number of parts of silica addition to 100 mass parts of magnetic toner particles) to magnetic toner particles (magnetic body content=43.5 mass %) provided by a pulverization method and having a volume-average particle diameter (Dv) of 8.0 μm (refer to FIGS. 2 and 3). Silica fine particles with a volume-average particle diameter (Dv) of 15 nm were used for the silica fine particles. For the calculation of the theoretical coverage ratio, 2.2 g/cm$^3$ was used for the true specific gravity of the silica fine particles; 1.65 g/cm$^3$ was used for the true specific gravity of the magnetic toner; and monodisperse particles with a particle diameter of 15 nm and 8.0 μm were assumed for, respectively, the silica fine particles and the magnetic toner particles.

As shown in FIG. 2, the theoretical coverage ratio exceeds 100% as the number of parts of addition of the silica fine particles is increased. On the other hand, the actual coverage ratio obtained through observation does vary with the number of parts of addition of the silica fine particles, but does not exceed 100%. This is due to silica fine particles being present to some degree as aggregates on the magnetic toner surface or is due to a large effect from the silica fine particles not being spherical.

Moreover, according to investigations by the present inventors, it was found that, even at the same amount of addition by the silica fine particles, the coverage ratio varied with the external addition technique. That is, it is not possible to determine the coverage ratio uniquely from the amount of addition of the inorganic fine particles (refer to FIG. 3). Here, external addition condition A refers to mixing at 1.0 W/g for a processing time of 5 minutes using the apparatus shown in FIG. 6. External addition condition B refers to mixing at 4000 rpm for a processing time of 2 minutes using an FM10C Henschel mixer (from Mitsui Miike Chemical Engineering Machinery Co., Ltd.).

For the reasons provided in the preceding, the present inventors used the inorganic fine particle coverage ratio obtained by SEM observation of the magnetic toner surface.

In addition, as has been thus explained, it is thought that the attachment force to a member can be reduced by raising the coverage ratio by the inorganic fine particles. Tests were therefore carried out on the attachment force with a member and the coverage ratio by the inorganic fine particles.

The relationship between the coverage ratio for the magnetic toner and the attachment force with a member was indirectly inferred by measuring the static friction coefficient between an aluminum substrate and spherical polystyrene particles having different coverage ratios by silica fine particles.

Specifically, the relationship between the coverage ratio and the static friction coefficient was determined using spherical polystyrene particles (weight-average particle diameter (D4)=7.5 μm) that had different coverage ratios (coverage ratio determined by SEM observation) by silica fine particles.

Figure 4:
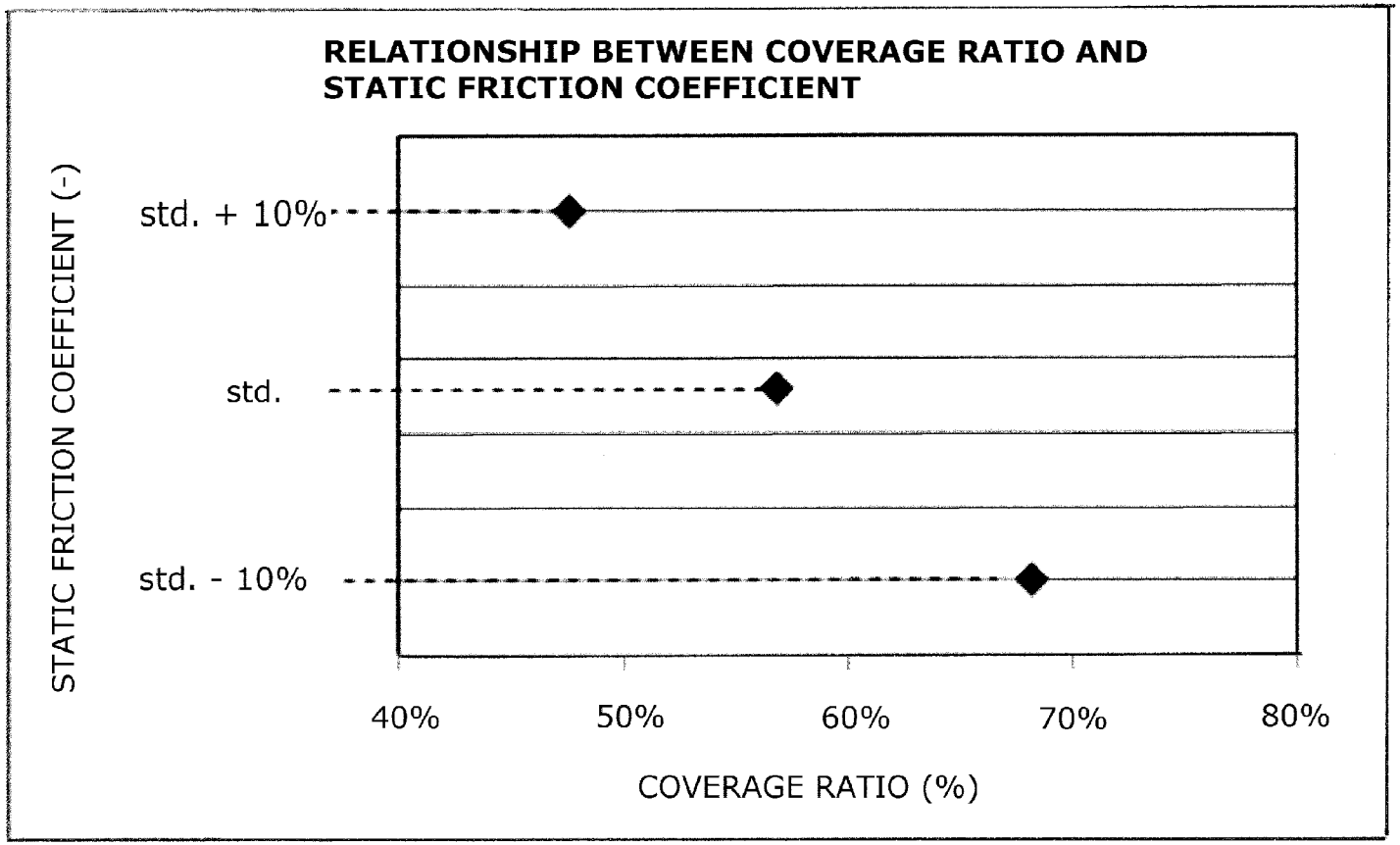
FIG. 4 is a diagram that shows an example of the relationship between the coverage ratio by an external additive and the static friction coefficient.

More specifically, spherical polystyrene particles to which silica fine particles had been added were pressed onto an aluminum substrate. The substrate was moved to the left and right while changing the pressing pressure, and the static friction coefficient was calculated from the resulting stress. This was performed for the spherical polystyrene particles at each different coverage ratio, and the obtained relationship between the coverage ratio and the static friction coefficient is shown in FIG. 4.

The static friction coefficient determined by the preceding technique is thought to correlate with the sum of the van der Waals and reflection forces acting between the spherical polystyrene particles and the substrate. As shown in FIG. 4, a higher coverage ratio by the silica fine particles exhibits a trend resulting in a lower static friction coefficient. More specifically, it is assumed that a magnetic toner that presents a high coverage ratio by inorganic fine particles also has a low attachment force for members.

On the other hand, letting the coverage ratio B (%) be the coverage ratio of the magnetic toner particles' surface by inorganic fine particles that are fixed to the magnetic toner particles' surface, the ratio [coverage ratio B/coverage ratio A, also referred to hereafter simply as B/A] of this coverage ratio B to the coverage ratio A is from at least 0.50 to not more than 0.85.

The coverage ratio B gives the coverage ratio by inorganic fine particles that are fixed to the magnetic toner particles' surface and are not released in the release process described below. It is thought that the inorganic fine particles represented by the coverage ratio B are fixed in a semi-embedded state to the surface of the magnetic toner particles and therefore do not undergo displacement even when the toner is subjected to shear by, for example, tribocharging in the developing assembly.

It is crucial for the present invention that B/A be from at least 0.50 to not more than 0.85, while B/A is preferably from at least 0.55 to not more than 0.80.

That B/A is at least 0.50 to not more than 0.85 means that inorganic fine particles fixed to the magnetic toner particles' surface are present to a certain degree and that in addition inorganic fine particles in a readily releasable state (a state that enables behavior separated from the magnetic toner particle) are also present in a favorable amount.

The inventors discovered that, in comparison to a B/A of less than 0.50 at the same total amount of inorganic fine particles, the fixing performance of the magnetic toner is improved by having the B/A be at least 0.50 and having the inorganic fine particles be implanted to a certain degree in the magnetic toner particle. The reasons for this are thought to be as follows.

The released inorganic fine particles readily aggregate with each other to become aggregates, and this impedes heat conduction and prevents melting of the magnetic toner particles. By raising B/A, these inorganic fine particles can be reduced and the heat can be effectively transferred.

Furthermore, the present inventors discovered that, by having the softening temperature (Ts) of the magnetic toner and B/A be in the ranges given above, a synergistic effect operates with regard to improving the fixing performance. The reasons for this are thought to be as follows: there are originally few releasable inorganic fine particles and, in addition, these inorganic fine particles are instantaneously implanted in the magnetic toner particles in the fixing zone and as a consequence the magnetic toner particles cohere with each other and the thermal conductivity is raised. It is thought that due to this an excellent low-temperature fixability is exhibited also in the case of a high coverage ratio of the magnetic toner particles by the inorganic fine particles.

On the other hand, the releasable inorganic fine particles, by sliding on the magnetic toner surface, provide a bearing-like effect and inhibit magnetic toner aggregation and also facilitate a reduction in the attachment force with apparatus members and between the magnetic toners. Due to this, the magnetic toner developed onto the electrostatic latent image-bearing member within the developing device assumes a loosened state without aggregation and assumes a state approximating closest packing. In addition, it is thought that since a reduction in the attachment force with apparatus members is facilitated, the transferability is improved and the surface of the unfixed image is made flat and smooth also when the magnetic toner is transferred from the electrostatic latent image-bearing member onto the recording medium. Thus, the magnetic toner can be loaded in a state approximating closest packing onto the recording medium and the heat from the heating element can then be applied uniformly and efficiently to the magnetic toner. Due to this, B/A is favorably controlled to not more than 0.85. It is thought that by having the B/A be from at least 0.50 to not more than 0.85, the releasable inorganic fine particles are suitably present and as a consequence an excellent fixing performance is obtained for the reasons provided above.

In addition, considered from the perspective of low-temperature fixing, an endothermic peak is preferably present from at least 60° C. to not more than 90° C. when the magnetic toner of the present invention is measured using a differential scanning calorimeter (DSC). From at least 60° C. to not more than 80° C. is more preferred. This presence of an endothermic peak at from at least 60° C. to not more than 90° C. indicates that the release agent within the magnetic toner melts in this temperature range and plasticizes the binder resin. The occurrence of the endothermic peak at not more than 90° C. is preferred because this is favorable for low-temperature fixing. When, on the other hand, the endothermic peak is less than 60° C., the storage stability of the magnetic toner tends to decline. This endothermic peak can be adjusted into the above-indicated range using the composition of the release agent. Specifically, the endothermic peak can be lowered by lowering the molecular weight of the release agent.

The coefficient of variation on the coverage ratio A is preferably not more than 10.0% in the present invention. Not more than 8.0% is more preferred. The specification of a coefficient of variation on the coverage ratio A of not more than 10.0% indicates that the inorganic fine particles uniformly cover the magnetic toner particles' surface. In addition, it indicates that there is little variation in the coverage ratio A between magnetic toner particles. Due to this, only a small proportion of the magnetic toner particle core is exposed and the frequency of contact between exposed regions is low, as a consequence of which the storage stability is improved even further. Moreover, because the toner-to-toner aggregative forces are also reduced and a closest packed structure is readily assumed on the recording medium, this is also advantageous for low-temperature fixing. There are no particular limitations on the technique for bringing the coefficient of variation to 10.0% or below, but the use is preferred of the external addition apparatus and technique described below, which are capable of bringing about a high degree of spreading of the metal oxide fine particles, e.g., silica fine particles, over the magnetic toner particles' surface.

The glass-transition temperature (Tg) of the magnetic toner is preferably from at least 45° C. to not more than 55° C. in the present invention. From at least 50° C. to not more than 55° C. is more preferred. The glass-transition temperature of the magnetic toner exerts an influence on the storage stability. As has been described up to this point, the storage stability is substantially improved in the present invention by controlling the state of attachment of the inorganic fine particles to the magnetic toner particles' surface; however, when the glass-transition temperature is less than 45° C., blocking between the magnetic toners tends to readily occur in a high-temperature environment. When, on the other hand, the glass-transition temperature exceeds 55° C., the softening temperature (Ts) is then high and the low-temperature fixability tends to decline. The glass-transition temperature of this magnetic toner can be controlled using, for example, the composition of the binder resin, the type of release agent, and the molecular weight of the binder resin.

The molecular weight distribution of the tetrahydrofuran (THF)-soluble matter in the magnetic toner of the present invention, as measured by gel permeation chromatography (GPC), preferably has a main peak ($M_A$) in the region from a molecular weight of at least $5\times10^3$ to not more than $1\times10^4$, a sub peak ($M_B$) in the region from a molecular weight of at least $1\times10^5$ to not more than $5\times10^5$, and a ratio [$S_A/(S_A+S_B)$]

of the main peak area ($S_A$) to the sum total area of the main peak area and the subpeak area ($S_B$) of at least 70%.

Figure 5:
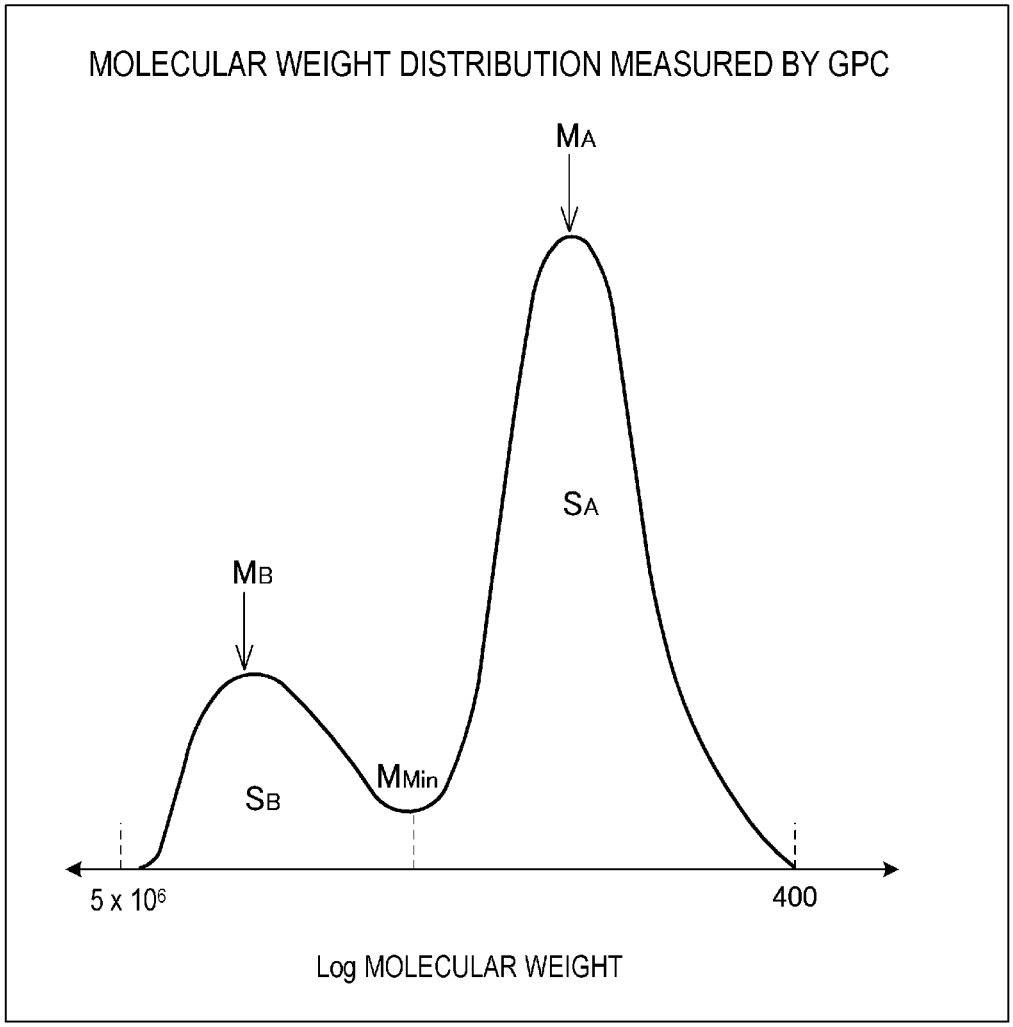
FIG. 5 is a molecular weight distribution curve for a magnetic toner.

Here, as shown in FIG. 5, a minimum value ($M_{Min}$) is present between the main peak ($M_A$) and the sub peak ($M_B$), and the area of the molecular weight distribution curve from a molecular weight of 400 to the minimum value ($M_{Min}$) is designated as $S_A$ while the area of the molecular weight distribution curve from the minimum value ($M_{Min}$) to a molecular weight of $5\times10^6$ is designated as $S_B$.

Low-temperature fixing can be achieved to an even greater degree by controlling the main peak molecular weight ($M_A$) into a low region from at least $5\times10^3$ to not more than $1\times10^4$. The low-temperature fixability tend to deteriorate when the main peak molecular weight ($M_A$) exceeds $1\times10^4$, while less than $5\times10^3$ may not be advantageous from the standpoint of the storage stability. In addition, an excellent offset resistance can be maintained by having the sub peak molecular weight ($M_B$) be from at least $1\times10^5$ to not more than $5\times10^5$. Hot offset may be readily produced at less than $1\times10^5$, while more than $5\times10^5$ may not be advantageous due to the occurrence of problems with fixing. Here, low-temperature fixing can coexist in balance with the offset resistance when the ratio [$S_A/(S_A+S_B)$] of the main peak area ($S_A$) to the sum total area of the main peak area and the sub peak area ($S_B$) is at least 70%, and this is therefore preferred. Less than 70% may not be advantageous because there is then little of the component from a molecular weight of at least $5\times10^3$ to not more than $1\times10^4$ that contributes to low-temperature fixing.

The molecular weight distribution under consideration can be adjusted by using a combination of a low molecular weight resin and a high molecular weight resin. Here, "low molecular weight resin" denotes a resin in which the main component is the styrene resin described below wherein the peak molecular weight is approximately from 4000 to 20000. On the other hand, the "high molecular weight resin" denotes a resin in which the main component is the styrene resin described below wherein the peak molecular weight is approximately 100000 to 600000.

The binder resin in the magnetic toner of the present invention contains a styrene resin, while the release agent contains a monoester compound or a diester compound. As previously described, this is because the monoester compound or diester compound is favorably compatible with the styrene resin, thereby providing an excellent low-temperature fixability and storage stability for the resin.

Styrene copolymers, e.g., styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers, and styrene-maleate copolymers, are specifically preferred for the binder resin because they are polar and exhibit an elevated compatibility with the monoester compound or diester compound. A single one of these may be used or a plurality may be used in combination.

The release agent, on the other hand, contains a monoester compound or diester compound as noted above. Between the two, the monoester compound provides the better low-temperature fixability because the ester compound readily takes on a straight-chain form and has a high compatibility with the binder resin. Preferred specific examples of the monoester compound are waxes in which the main component is a fatty acid ester, such as carnauba wax and montanic acid ester waxes; monoester compounds provided by the partial or complete deacidification of the acid component from a fatty acid ester, such as deacidified carnauba wax; monoester compounds obtained by, for example, the hydrogenation of a plant oil or fat; methyl ester compounds that contain the hydroxyl group; and saturated fatty acid monoesters such as stearyl stearate and behenyl behenate. In addition, preferred specific examples of the diester compound are dibehenyl sebacate, nonanediol dibehenate, dibehenyl terephthalate, and distearyl terephthalate. In addition to the aforementioned monoester compound or diester compound, the release agent used in the present invention may also contain another, known wax within a range that does not impair the effects of the present invention.

The release agent content, expressed with reference to the total amount of the binder resin, is preferably from at least 1.0 mass % to not more than 30.0 mass % and more preferably is from at least 3.0 mass % to not more than 25.0 mass %.

The inhibitory effect on the cold offset tends to decline when the release agent content is less than 1.0 mass %, while when 30.0 mass % is exceeded, the long-term storage stability tends to decline and a decline in the transfer efficiency may be induced by a decline in the uniformity of magnetic toner charging due to, for example, exudation to the magnetic toner surface.

The magnetic body present in the magnetic toner in the present invention can be exemplified by iron oxides such as magnetite, maghemite, ferrite, and so forth; metals such as iron, cobalt, and nickel; and alloys and mixtures of these metals with metals such as aluminum, copper, magnesium, tin, zinc, beryllium, calcium, manganese, selenium, titanium, tungsten, and vanadium.

The number-average particle diameter (D1) of the primary particles of the magnetic bodies is preferably not more than 0.50 μm and more preferably is from 0.05 μm to 0.30 μm.

With regard to the magnetic characteristics for the magnetic field application of 795.8 kA/m, the coercive force (Hc) is preferably from 1.6 to 12.0 kA/m; the intensity of magnetization (σs) is preferably from 50 to 200 $Am^2/kg$ and more preferably is from 50 to 100 $Am^2/kg$; and the residual magnetization (σr) is preferably from 2 to 20 $Am^2/kg$.

The content of the magnetic body in the magnetic toner of the present invention is preferably from at least 35 mass % to not more than 50 mass % and more preferably is from at least 40 mass % to not more than 50 mass %.

When the content of the magnetic body in the magnetic toner is less than 35 mass %, the magnetic attraction to the magnet roller in the developing sleeve declines and the fogging tends to worsen.

When, on the other hand, the magnetic body content exceeds 50 mass %, the developing performance tends to decline and the image density may decline.

The content of the magnetic body in the magnetic toner can be measured using a TGA Q5000IR thermal analyzer from PerkinElmer Inc. With regard to the measurement method, the magnetic toner is heated from normal temperature to 900° C. under a nitrogen atmosphere at a rate of temperature rise of 25° C./minute: the mass loss from 100 to 750° C. is taken to be the component provided by subtracting the magnetic body from the magnetic toner and the residual mass is taken to be the amount of the magnetic body.

A charge control agent is preferably added to the magnetic toner of the present invention. Moreover, a negative-charging toner is preferred for the toner of the present invention.

Organometal complex compounds and chelate compounds are effective as charging agents for negative charging and can be exemplified by monoazo-metal complex compounds; acetylacetone-metal complex compounds; and metal complex compounds of aromatic hydroxycarboxylic acids and aromatic dicarboxylic acids. Specific examples of commercially available products are Spilon Black TRH, T-77, and T-95 (Hodogaya Chemical Co., Ltd.) and BONTRON (registered trademark) S-34, S-44, S-54, E-84, E-88, and E-89 (Orient Chemical Industries Co., Ltd.).

A single one of these charge control agents may be used or two or more may be used in combination. Considered from the standpoint of the amount of charging of the magnetic toner, these charge control agents are used, expressed per 100 mass parts of the binder resin, preferably at from 0.1 to 10.0 mass parts and more preferably at from 0.1 to 5.0 mass parts.

The magnetic toner of the present invention contains inorganic fine particles at the magnetic toner particles' surface.

The inorganic fine particles present on the magnetic toner particles' surface can be exemplified by silica fine particles, titania fine particles, and alumina fine particles, and these inorganic fine particles can also be favorably used after the execution of a hydrophobic treatment on the surface thereof.

It is critical that the inorganic fine particles present on the surface of the magnetic toner particles in the present invention contain at least one of metal oxide fine particle selected from the group consisting of silica fine particles, titania fine particles, and alumina fine particles, and that at least 85 mass % of the metal oxide fine particles be silica fine particles. Preferably at least 90 mass % of the metal oxide fine particles are silica fine particles. The reasons for this are that silica fine particles not only provide the best balance with regard to imparting charging performance and flowability, but are also excellent from the standpoint of lowering the aggregative forces within the magnetic toner.

The reason why silica fine particles are excellent from the standpoint of lowering the aggregative forces between the magnetic toners are not entirely clear, but it is hypothesized that this is probably due to the substantial operation of the previously described bearing effect with regard to the sliding behavior between the silica fine particles.

In addition, silica fine particles are preferably the main component of the inorganic fine particles fixed to the magnetic toner particle surface. Specifically, the inorganic fine particles fixed to the magnetic toner particle surface preferably contain at least one of metal oxide fine particle selected from the group consisting of silica fine particles, titania fine particles, and alumina fine particles wherein silica fine particles are at least 80 mass % of these metal oxide fine particles. The silica fine particles are more preferably at least 90 mass %. This is hypothesized to be for the same reasons as discussed above: silica fine particles are the best from the standpoint of imparting charging performance and flowability, and as a consequence a rapid initial rise in magnetic toner charge occurs. The result is that a high image density can be obtained, which is strongly preferred.

Here, the timing and amount of addition of the inorganic fine particles may be adjusted in order to bring the silica fine particles to at least 85 mass % of the metal oxide fine particles present on the magnetic toner particle surface and in order to also bring the silica fine particles to at least 80 mass % with reference to the metal oxide particles fixed on the magnetic toner particle surface.

The amount of inorganic fine particles present can be checked using the methods described below for quantitating the inorganic fine particles.

The number-average particle diameter (D1) of the primary particles in the inorganic fine particles in the present invention is preferably from at least 5 nm to not more than 50 nm, and more preferably is from at least 10 nm to not more than 35 nm.

Bringing the number-average particle diameter (D1) of the primary particles in the inorganic fine particles into the indicated range facilitates favorable control of the coverage ratio A and B/A. When the primary particle number-average particle diameter (D1) is less than 5 nm, the inorganic fine particles tend to aggregate with one another and tend to obtain a large value for B/A and the coefficient of variation on the coverage ratio A is also prone to assume large values. When, on the other hand, the primary particle number-average particle diameter (D1) exceeds 50 nm, the coverage ratio A is prone to be small even at large amounts of addition of the inorganic fine particles; in addition, B/A will also tend to have a low value because it becomes difficult for the inorganic fine particles to be fixed to the magnetic toner particles. That is, it is prone to difficult to obtain the above-described attachment force-reducing effect and bearing effect when the primary particle number-average particle diameter (D1) is greater than 50 nm.

A hydrophobic treatment is preferably carried out on the inorganic fine particles used in the present invention, and particularly preferred inorganic fine particles will have been hydrophobically treated to a hydrophobicity, as measured by the methanol titration test, of at least 40% and more preferably at least 50%.

The method for carrying out the hydrophobic treatment can be exemplified by methods in which treatment is carried out with, e.g., an organosilicon compound, a silicone oil, a long-chain fatty acid, and so forth.

The organosilicon compound can be exemplified by hexamethyldisilazane, trimethylsilane, trimethylethoxysilane, isobutyltrimethoxysilane, trimethylchlorosilane, dimethyldichlorosilane, methyltrichlorosilane, dimethylethoxysilane, dimethyldimethoxysilane, diphenyldiethoxysilane, and hexamethyldisiloxane. A single one of these can be used or a mixture of two or more can be used.

The silicone oil can be exemplified by dimethylsilicone oil, methylphenylsilicone oil, α-methylstyrene-modified silicone oil, chlorophenyl silicone oil, and fluorine-modified silicone oil.

A $C_{10-22}$ fatty acid is suitably used for the long-chain fatty acid, and the long-chain fatty acid may be a straight-chain fatty acid or a branched fatty acid. A saturated fatty acid or an unsaturated fatty acid may be used.

Among the preceding, $C_{10-22}$ straight-chain saturated fatty acids are highly preferred because they readily provide a uniform treatment of the surface of the inorganic fine particles.

These straight-chain saturated fatty acids can be exemplified by capric acid, lauric acid, myristic acid, palmitic acid, stearic acid, arachidic acid, and behenic acid.

Inorganic fine particles that have been treated with silicone oil are preferred for the inorganic fine particles used in the present invention, and inorganic fine particles treated with an organosilicon compound and a silicone oil are more preferred. This makes possible a favorable control of the hydrophobicity.

The method for treating the inorganic fine particles with a silicone oil can be exemplified by a method in which the silicone oil is directly mixed, using a mixer such as a Henschel mixer, with inorganic fine particles that have been treated with an organosilicon compound, and by a method in which the silicone oil is sprayed on the inorganic fine particles. Another example is a method in which the silicone oil is dissolved or dispersed in a suitable solvent; the inorganic fine particles are then added and mixed; and the solvent is removed.

In order to obtain a good hydrophobicity, the amount of silicone oil used for the treatment, expressed per 100 mass parts of the inorganic fine particles, is preferably from at least 1 mass parts to not more than 40 mass parts and is more preferably from at least 3 mass parts to not more than 35 mass parts.

In order to impart an excellent flowability to the magnetic toner, the silica fine particles, titania fine particles, and alumina fine particles used by the present invention have a specific surface area as measured by the BET method based on nitrogen adsorption (BET specific surface area) preferably of from at least 20 $m^2/g$ to not more than 350 $m^2/g$ and more preferably of from at least 25 $m^2/g$ to not more than 300 $m^2/g$.

Measurement of the specific surface area (BET specific surface area) by the BET method based on nitrogen adsorption is performed based on JIS Z8830 (2001). A "TriStar300 (Shimadzu Corporation) automatic specific surface area•pore distribution analyzer", which uses gas adsorption by a constant volume technique as its measurement procedure, is used as the measurement instrument.

The amount of addition of the inorganic fine particles, expressed per 100 mass parts of the magnetic toner particles, is preferably from at least 1.5 mass parts to not more than 3.0 mass parts of the inorganic fine particles, more preferably from at least 1.5 mass parts to not more than 2.6 mass parts, and even more preferably from at least 1.8 mass parts to not more than 2.6 mass parts.

Setting the amount of addition of the inorganic fine particles in the indicated range is also preferred from the standpoint of facilitating appropriate control of the coverage ratio A and B/A and also from the standpoint of the image density and fogging.

Exceeding 3.0 mass parts for the amount of addition of the inorganic fine particles, even if an external addition apparatus and an external addition method could be devised, gives rise to release of the inorganic fine particles and facilitates the appearance of, for example, a streak on the image.

In addition to the above-described inorganic fine particles, particles with a primary particle number-average particle diameter (D1) of from at least 80 nm to not more than 3 μm may be added to the magnetic toner of the present invention. For example, a lubricant, e.g., a fluororesin powder, zinc stearate powder, or polyvinylidene fluoride powder; a polish, e.g., a cerium oxide powder, a silicon carbide powder, a strontium titanate powder, or a spacer particle such as silica, may also be added in small amounts that do not influence the effects of the present invention.

<Quantitation Methods for the Inorganic Fine Particles>

(1) Determination of the Content of Silica Fine Particles in the Magnetic Toner (Standard Addition Method)

3 g of the magnetic toner is introduced into an aluminum ring having a diameter of 30 mm and a pellet is prepared using a pressure of 10 tons. The silicon (Si) intensity is determined (Si intensity-1) by wavelength-dispersive x-ray fluorescence analysis (XRF). The measurement conditions are preferably optimized for the XRF instrument used and all of the intensity measurements in a series are performed using the same conditions. Silica fine particles with a primary particle number-average particle diameter of 12 nm are added to the magnetic toner at 1.0 mass % with reference to the magnetic toner and mixing is carried out with a coffee mill.

For the silica fine particles admixed at this time, silica fine particles with a primary particle number-average particle diameter of from at least 5 nm to not more than 50 nm can be used without affecting this determination.

After mixing, pellet fabrication is carried out as described above and the Si intensity (Si intensity-2) is determined also as described above. Using the same procedure, the Si intensity (Si intensity-3, Si intensity-4) is also determined for samples prepared by adding and mixing the silica fine particles at 2.0 mass % and 3.0 mass % of the silica fine particles with reference to the magnetic toner. The silica content (mass %) in the magnetic toner based on the standard addition method is calculated using Si intensities-1 to -4.

The titania content (mass %) in the magnetic toner and the alumina content (mass %) in the magnetic toner are determined using the standard addition method and the same procedure as described above for the determination of the silica content. That is, for the titania content (mass %), titania fine particles with a primary particle number-average particle diameter of from at least 5 nm to not more than 50 nm are added and mixed and the determination can be made by determining the titanium (Ti) intensity. For the alumina content (mass %), alumina fine particles with a primary particle number-average particle diameter of from at least 5 nm to not more than 50 nm are added and mixed and the determination can be made by determining the aluminum (Al) intensity.

(2) Separation of the Inorganic Fine Particles from the Magnetic Toner 5 g of the magnetic toner is weighed using a precision balance into a lidded 200-mL plastic cup; 100 mL methanol is added; and dispersion is carried out for 5 minutes using an ultrasound disperser. The magnetic toner is held using a neodymium magnet and the supernatant is discarded. The process of dispersing with methanol and discarding the supernatant is carried out three times, followed by the addition of 100 mL of 10% NaOH and several drops of "Contaminon N" (a 10 mass % aqueous solution of a neutral pH 7 detergent for cleaning precision measurement instrumentation and comprising a nonionic surfactant, an anionic surfactant, and an organic builder, from Wako Pure Chemical Industries, Ltd.), light mixing, and then standing at quiescence for 24 hours. This is followed by re-separation using a neodymium magnet. Repeated washing with distilled water is carried out at this point until NaOH does not remain. The recovered particles are thoroughly dried using a vacuum drier to obtain particles A. The externally added silica fine particles are dissolved and removed by this process. Titania fine particles and alumina fine particles can remain present in particles A since they are sparingly soluble in 10% NaOH.

(3) Measurement of the Si Intensity in the Particles A 3 g of the particles A are introduced into an aluminum ring with a diameter of 30 mm; a pellet is fabricated using a pressure of 10 tons; and the Si intensity (Si intensity-5) is determined by wavelength-dispersive XRF. The silica content (mass %) in particles A is calculated using the Si intensity-5 and the Si intensities-1 to -4 used in the determination of the silica content in the magnetic toner.

(4) Separation of the Magnetic Body from the Magnetic Toner 100 mL of tetrahydrofuran is added to 5 g of the particles A with thorough mixing followed by ultrasound dispersion for 10 minutes. The magnetic body is held with a magnet and the supernatant is discarded. This process is performed 5 times to obtain particles B. This process can almost completely remove the organic component, e.g., resins, outside the magnetic body. However, because a tetrahydrofuran-insoluble matter in the resin can remain, the particles B provided by this process are preferably heated to 800° C. in order to burn off the residual organic component, and the particles C obtained after heating are approximately the magnetic body that was present in the magnetic toner.

Measurement of the mass of the particles C yields the magnetic body content W (mass %) in the magnetic toner. In order to correct for the increment due to oxidation of the magnetic body, the mass of particles C is multiplied by 0.9666 ($Fe_2O_3 \rightarrow Fe_3O_4$).

(5) Measurement of the Ti Intensity and Al Intensity in the Separated Magnetic Body Ti and Al may be present as impurities or additives in the magnetic body. The amount of Ti and Al attributable to the magnetic body can be detected by FP quantitation in wavelength-dispersive XRF. The detected amounts of Ti and Al are converted to titania and alumina and the titania content and alumina content in the magnetic body are then calculated.

The amount of externally added silica fine particles, the amount of externally added titania fine particles, and the amount of externally added alumina fine particles are calculated by substituting the quantitative values obtained by the preceding procedures into the following formulas.

amount of externally added silica fine particles (mass %)=silica content (mass %) in the magnetic toner−silica content (mass %) in particle *A* amount of externally added titania fine particles (mass %)=titania content (mass %) in the magnetic toner−{titania content (mass %) in the magnetic body×magnetic body content *W*/100} amount of externally added alumina fine particles (mass %)=alumina content (mass %) in the magnetic toner−{alumina content (mass %) in the magnetic body×magnetic body content *W*/100}

(6) Calculation of the Proportion of Silica Fine Particles in the Metal Oxide Fine Particles Selected from the Group Consisting of Silica Fine Particles, Titania Fine Particles, and Alumina Fine Particles, for the Inorganic Fine Particles Fixed to the Magnetic Toner Particle Surface After carrying out the procedure, "Removing the unfixed inorganic fine particles", in the method described below for calculating the coverage ratio B and thereafter drying the magnetic toner, the proportion of the silica fine particles in the metal oxide fine particles can be calculated by carrying out the same procedures as in the method of (1) to (5) described above.

Examples of methods for producing the magnetic toner of the present invention are provided below, but there is no intent to limit the production method to these.

The magnetic toner of the present invention can be produced by any known method, without particular limitation, that has a step of adjusting the coverage ratio A and B/A.

The following method is a favorable example of such a production method. First, the binder resin, magnetic body, and release agent, and as necessary other materials, e.g., a charge control agent, are thoroughly mixed using a mixer such as a Henschel mixer or ball mill and are then melted, worked, and kneaded using a heated kneading apparatus such as a roll, kneader, or extruder to compatibilize the resins with each other.

The obtained melted and kneaded material is cooled and solidified and then coarsely pulverized, finely pulverized, and classified, and the external additives, e.g., inorganic fine particles, are externally added and mixed into the resulting magnetic toner particles to obtain the magnetic toner.

The mixer used here can be exemplified by the Henschel mixer (Mitsui Mining Co., Ltd.); Supermixer (Kawata Mfg. Co., Ltd.); Ribocone (Okawara Corporation); Nauta mixer, Turbulizer, and Cyclomix (Hosokawa Micron Corporation); Spiral Pin Mixer (Pacific Machinery & Engineering Co., Ltd.); Loedige Mixer (Matsubo Corporation); and Nobilta (Hosokawa Micron Corporation).

The aforementioned kneading apparatus can be exemplified by the KRC Kneader (Kurimoto, Ltd.); Buss Ko-Kneader (Buss Corp.); TEM extruder (Toshiba Machine Co., Ltd.); TEX twin-screw kneader (The Japan Steel Works, Ltd.); PCM Kneader (Ikegai Ironworks Corporation); three-roll mills, mixing roll mills, kneaders (Inoue Manufacturing Co., Ltd.); Kneadex (Mitsui Mining Co., Ltd.); model MS pressure kneader and Kneader-Ruder (Moriyama Mfg. Co., Ltd.); and Banbury mixer (Kobe Steel, Ltd.).

The aforementioned pulverizer can be exemplified by the Counter Jet Mill, Micron Jet, and Inomizer (Hosokawa Micron Corporation); IDS mill and PJM Jet Mill (Nippon Pneumatic Mfg. Co., Ltd.); Cross Jet Mill (Kurimoto, Ltd.); Ulmax (Nisso Engineering Co., Ltd.); SK Jet-O-Mill (Seishin Enterprise Co., Ltd.); Kryptron (Kawasaki Heavy Industries, Ltd.); Turbo Mill (Turbo Kogyo Co., Ltd.); and Super Rotor (Nisshin Engineering Inc.).

The aforementioned classifier can be exemplified by the Classiel, Micron Classifier, and Spedic Classifier (Seishin Enterprise Co., Ltd.); Turbo Classifier (Nisshin Engineering Inc.); Micron Separator, Turboplex (ATP), and TSP Separator (Hosokawa Micron Corporation); Elbow Jet (Nittetsu Mining Co., Ltd.); Dispersion Separator (Nippon Pneumatic Mfg. Co., Ltd.); and YM Microcut (Yasukawa Shoji Co., Ltd.).

Screening devices that can be used to screen the coarse particles can be exemplified by the Ultrasonic (Koei Sangyo Co., Ltd.), Rezona Sieve and Gyro-Sifter (Tokuju Corporation), Vibrasonic System (Dalton Co., Ltd.), Soniclean (Sintokogio, Ltd.), Turbo Screener (Turbo Kogyo Co., Ltd.), Microsifter (Makino Mfg. Co., Ltd.), and circular vibrating sieves.

Figure 6:
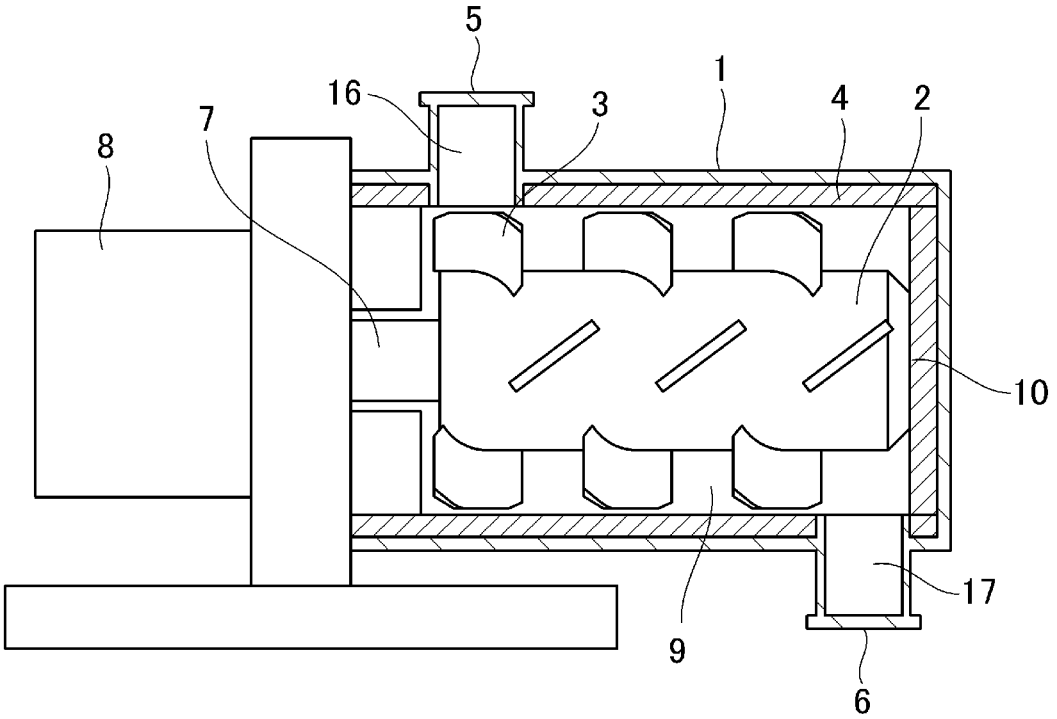
FIG. 6 is a schematic diagram that shows an example of a mixing process apparatus that can be used for the external addition and mixing of inorganic fine particles.

A known mixing process apparatus, e.g., the mixers described above, can be used for the mixing process apparatus for the external addition and mixing of the inorganic fine particles; however, an apparatus as shown in FIG. 6 is preferred from the standpoint of enabling facile control of the coverage ratio A, B/A, and the coefficient of variation on the coverage ratio A.

FIG. 6 is a schematic diagram that shows an example of a mixing process apparatus that can be used to carry out the external addition and mixing of the inorganic fine particles used by the present invention.

This mixing process apparatus readily brings about fixing of the inorganic fine particles to the magnetic toner particle surface because it has a structure that applies shear in a narrow clearance region to the magnetic toner particles and the inorganic fine particles.

Furthermore, as described below, the coverage ratio A, B/A, and the coefficient of variation on the coverage ratio A are easily controlled into the ranges preferred for the present invention because circulation of the magnetic toner particles and inorganic fine particles in the axial direction of the rotating member is facilitated and because a thorough and uniform mixing is facilitated prior to the development of fixing.

Figure 7:
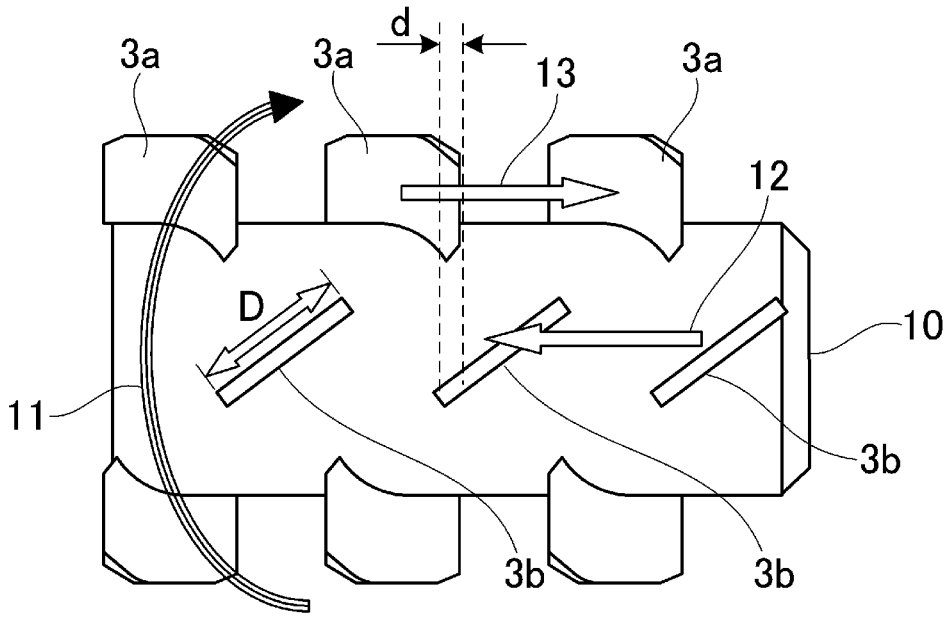
FIG. 7 is a schematic diagram that shows an example of the structure of a stirring member used in the mixing process apparatus.

On the other hand, FIG. 7 is a schematic diagram that shows an example of the structure of the stirring member used in the aforementioned mixing process apparatus.

The external addition and mixing process for the inorganic fine particles is described below using FIGS. 6 and 7.

This mixing process apparatus that carries out external addition and mixing of the inorganic fine particles has a rotating member 2, on the surface of which at least a plurality of stirring members 3 are disposed; a drive member 8, which drives the rotation of the rotating member; and a main casing 1, which is disposed to have a gap with the stirring members 3.

It is important that the gap (clearance) between the inner circumference of the main casing 1 and the stirring member 3 be maintained constant and very small in order to apply a uniform shear to the magnetic toner particles and facilitate the fixing of the inorganic fine particles to the magnetic toner particle surface.

The diameter of the inner circumference of the main casing 1 in this apparatus is not more than twice the diameter of the outer circumference of the rotating member 2. In FIG. 6, an example is shown in which the diameter of the inner circumference of the main casing 1 is 1.7-times the diameter of the outer circumference of the rotating member 2 (the trunk diameter provided by subtracting the stirring member 3 from the rotating member 2). When the diameter of the inner circumference of the main casing 1 is not more than twice the diameter of the outer circumference of the rotating member 2, impact force is satisfactorily applied to the magnetic toner particles since the processing space in which forces act on the magnetic toner particles is suitably limited.

In addition, it is important that the aforementioned clearance be adjusted in conformity to the size of the main casing. Viewed from the standpoint of the application of adequate shear to the magnetic toner particles, it is important that the clearance be made from about at least 1% to not more than 5% of the diameter of the inner circumference of the main casing 1. Specifically, when the diameter of the inner circumference of the main casing 1 is approximately 130 mm, the clearance is preferably made approximately from at least 2 mm to not more than 5 mm; when the diameter of the inner circumference of the main casing 1 is about 800 mm, the clearance is preferably made approximately from at least 10 mm to not more than 30 mm.

In the process of the external addition and mixing of the inorganic fine particles in the present invention, mixing and external addition of the inorganic fine particles to the magnetic toner particle surface are performed using the mixing process apparatus by rotating the rotating member 2 by the drive member 8 and stirring and mixing the magnetic toner particles and inorganic fine particles that have been introduced into the mixing process apparatus.

As shown in FIG. 7, at least a portion of the plurality of stirring members 3 is formed as a forward transport stirring member 3*a* that, accompanying the rotation of the rotating member 2, transports the magnetic toner particles and inorganic fine particles in one direction along the axial direction of the rotating member. In addition, at least a portion of the plurality of stirring members 3 is formed as a back transport stirring member 3*b* that, accompanying the rotation of the rotating member 2, returns the magnetic toner particles and inorganic fine particles in the other direction along the axial direction of the rotating member.

Here, when the raw material inlet port 5 and the product discharge port 6 are disposed at the two ends of the main casing 1, as in FIG. 6, the direction toward the product discharge port 6 from the raw material inlet port 5 (the direction to the right in FIG. 6) is the "forward direction".

That is, as shown in FIG. 7, the face of the forward transport stirring member 3*a* is tilted so as to transport the magnetic toner particles in the forward direction (13). On the other hand, the face of the back transport stirring member 3*b* is tilted so as to transport the magnetic toner particles and the inorganic fine particles in the back direction (12).

By doing this, the external addition of the inorganic fine particles to the surface of the magnetic toner particles and mixing are carried out while repeatedly performing transport in the "forward direction" (13) and transport in the "back direction" (12).

In addition, with regard to the stirring members 3*a*, 3*b*, a plurality of members disposed at intervals in the circumferential direction of the rotating member 2 form a set. In the example shown in FIG. 7, two members at an interval of 180° with each other form a set of the stirring members 3*a*, 3*b* on the rotating member 2, but a larger number of members may form a set, such as three at an interval of 120° or four at an interval of 90°.

In the example shown in FIG. 7, a total of twelve stirring members 3*a*, 3*b* are formed at an equal interval.

Furthermore, D in FIG. 7 indicates the width of a stirring member and d indicates the distance that represents the overlapping portion of a stirring member. In FIG. 7, D is preferably a width that is approximately from at least 20% to not more than 30% of the length of the rotating member 2, when considered from the standpoint of bringing about an efficient transport of the magnetic toner particles and inorganic fine particles in the forward direction and back direction. FIG. 7 shows an example in which D is 23%. Furthermore, with regard to the stirring members 3*a* and 3*b*, when an extension line is drawn in the perpendicular direction from the location of the end of the stirring member 3*a*, a certain overlapping portion d of the stirring member with the stirring member 3*b* is preferably present. This serves to efficiently apply shear to the magnetic toner particles. This d is preferably from at least 10% to not more than 30% of D from the standpoint of the application of shear.

In addition to the shape shown in FIG. 7, the blade shape may be—insofar as the magnetic toner particles can be transported in the forward direction and back direction and the clearance is retained—a shape having a curved surface or a paddle structure in which a distal blade element is connected to the rotating member 2 by a rod-shaped arm.

The present invention will be described in additional detail herebelow with reference to the schematic diagrams of the apparatus shown in FIGS. 6 and 7.

The apparatus shown in FIG. 6 has a rotating member 2, which has at least a plurality of stirring members 3 disposed on its surface; a drive member 8 that drives the rotation of the rotating member 2; a main casing 1, which is disposed forming a gap with the stirring members 3; and a jacket 4, in which a heat transfer medium can flow and which resides on the inside of the main casing 1 and at the end surface 10 of the rotating member.

In addition, the apparatus shown in FIG. 6 has a raw material inlet port 5, which is formed on the upper side of the main casing 1 for the purpose of introducing the magnetic toner particles and the inorganic fine particles, and a product discharge port 6, which is formed on the lower side of the main casing 1 for the purpose of discharging, from the main casing to the outside, the magnetic toner that has been subjected to the external addition and mixing process.

The apparatus shown in FIG. 6 also has a raw material inlet port inner piece 16 inserted in the raw material inlet port 5 and a product discharge port inner piece 17 inserted in the product discharge port 6.

In the present invention, the raw material inlet port inner piece 16 is first removed from the raw material inlet port 5 and the magnetic toner particles are introduced into the processing space 9 from the raw material inlet port 5. Then, the inorganic fine particles are introduced into the processing space 9 from the raw material inlet port 5 and the raw material inlet port inner piece 16 is inserted. The rotating member 2 is subsequently rotated by the drive member 8 (11 represents the direction of rotation), and the thereby introduced material to be processed is subjected to the external addition and mixing process while being stirred and mixed by the plurality of stirring members 3 disposed on the surface of the rotating member 2.

The sequence of introduction may also be introduction of the inorganic fine particles through the raw material inlet port 5 first and then introduction of the magnetic toner particles through the raw material inlet port 5. In addition, the magnetic toner particles and the inorganic fine particles may be mixed in advance using a mixer such as a Henschel mixer and the mixture may thereafter be introduced through the raw material inlet port 5 of the apparatus shown in FIG. 6.

More specifically, with regard to the conditions for the external addition and mixing process, controlling the power of the drive member 8 to from at least 0.2 W/g to not more than 2.0 W/g is preferred in terms of obtaining the coverage ratio A, B/A, and the coefficient of variation on the coverage ratio A specified by the present invention. Controlling the power of the drive member 8 to from at least 0.6 W/g to not more than 1.6 W/g is more preferred.

When the power is lower than 0.2 W/g, it is difficult to obtain a high coverage ratio A, and B/A tends to be too low. On the other hand, B/A tends to be too high when 2.0 W/g is exceeded.

The processing time is not particularly limited, but is preferably from at least 3 minutes to not more than 10 minutes. When the processing time is shorter than 3 minutes, B/A tends to be low and a large coefficient of variation on the coverage ratio A is prone to occur. On the other hand, when the processing time exceeds 10 minutes, B/A conversely tends to be high and the temperature within the apparatus is prone to rise.

The rotation rate of the stirring members during external addition and mixing is not particularly limited; however, when, for the apparatus shown in FIG. 6, the volume of the processing space 9 in the apparatus is $2.0\times10^{-3}$ $m^3$, the rpm of the stirring members—when the shape of the stirring members 3 is as shown in FIG. 7—is preferably from at least 1000 rpm to not more than 3000 rpm. The coverage ratio A, B/A, and coefficient of variation on the coverage ratio A specified for the present invention are readily obtained at from at least 1000 rpm to not more than 3000 rpm.

A particularly preferred processing method for the present invention has a pre-mixing step prior to the external addition and mixing process step. Inserting a pre-mixing step achieves a very uniform dispersion of the inorganic fine particles on the magnetic toner particle surface, and as a result a high coverage ratio A is readily obtained and the coefficient of variation on the coverage ratio A is readily reduced.

More specifically, the pre-mixing processing conditions are preferably a power of the drive member 8 of from at least 0.06 W/g to not more than 0.20 W/g and a processing time of from at least 0.5 minutes to not more than 1.5 minutes. It is difficult to obtain a satisfactorily uniform mixing in the pre-mixing when the loaded power is below 0.06 W/g or the processing time is shorter than 0.5 minutes for the pre-mixing processing conditions. When, on the other hand, the loaded power is higher than 0.20 W/g or the processing time is longer than 1.5 minutes for the pre-mixing processing conditions, the inorganic fine particles may become fixed to the magnetic toner particle surface before a satisfactorily uniform mixing has been achieved.

After the external addition and mixing process has been finished, the product discharge port inner piece 17 in the product discharge port 6 is removed and the rotating member 2 is rotated by the drive member 8 to discharge the magnetic toner from the product discharge port 6. As necessary, coarse particles and so forth may be separated from the obtained magnetic toner using a screen or sieve, for example, a circular vibrating screen, to obtain the magnetic toner.

Figure 8:
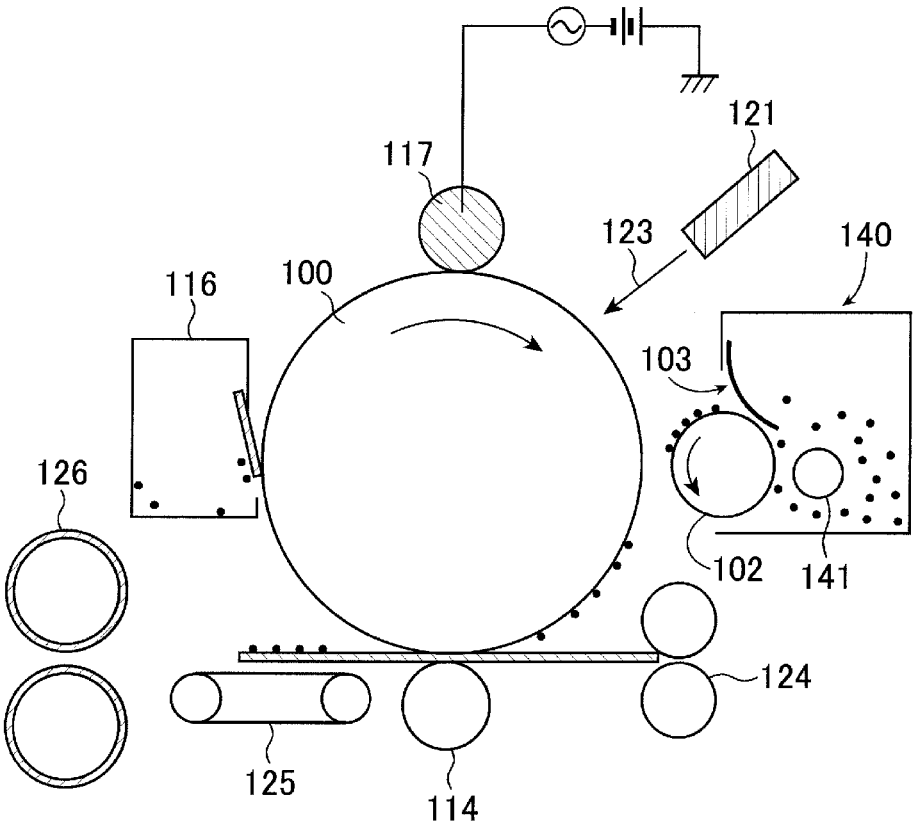
FIG. 8 is a diagram that shows an example of an image-forming apparatus.

An example of an image-forming apparatus that can advantageously use the magnetic toner of the present invention is specifically described below with reference to FIG. 8. In FIG. 8, 100 is an electrostatic latent image-bearing member (also referred to below as a photosensitive member), and the following, inter alia, are disposed on its circumference: a charging member 117 (hereinafter also called a charging roller), a developing device 140 having a toner-carrying member 102, a transfer member 114 (transfer roller), a cleaner container 116, a fixing unit 126, and a register roller 124. The electrostatic latent image-bearing member 100 is charged by the charging member 117. Photoexposure is performed by irradiating the electrostatic latent image-bearing member 100 with laser light from a laser generator 121 to form an electrostatic latent image corresponding to the intended image. The electrostatic latent image on the electrostatic latent image-bearing member 100 is developed by the developing device 140 with a monocomponent toner to provide a toner image, and the toner image is transferred onto a transfer material by the transfer member 114, which contacts the electrostatic latent image-bearing member with the transfer material interposed therebetween. The toner image-bearing transfer material is conveyed to the fixing unit 126 and fixing on the transfer material is carried out. In addition, the toner remaining to some extent on the electrostatic latent image-bearing member is scraped off by the cleaning blade and is stored in the cleaner container 116.

The methods for measuring the various properties referenced by the present invention are described below.

<Calculation of the Coverage Ratio A>

The coverage ratio A is calculated in the present invention by analyzing, using Image-Pro Plus ver. 5.0 image analysis software (Nippon Roper Kabushiki Kaisha), the image of the magnetic toner surface taken with Hitachi's S-4800 ultrahigh resolution field emission scanning electron microscope (Hitachi High-Technologies Corporation). The conditions for image acquisition with the S-4800 are as follows.

(1) Specimen Preparation

An electroconductive paste is spread in a thin layer on the specimen stub (15 mm×6 mm aluminum specimen stub) and the magnetic toner is sprayed onto this. Additional blowing with air is performed to remove excess magnetic toner from the specimen stub and carry out thorough drying. The specimen stub is set in the specimen holder and the specimen stub height is adjusted to 36 mm with the specimen height gauge.

(2) Setting the Conditions for Observation with the 5-4800

The coverage ratio A is calculated using the image obtained by backscattered electron imaging with the 5-4800. The coverage ratio A can be measured with excellent accuracy using the backscattered electron image because the inorganic fine particles are charged up less than is the case with the secondary electron image.

Introduce liquid nitrogen to the brim of the anti-contamination trap located in the S-4800 housing and allow to stand for 30 minutes. Start the "PC-SEM" of the S-4800 and perform flashing (the FE tip, which is the electron source, is cleaned). Click the acceleration voltage display area in the control panel on the screen and press the [flashing] button to open the flashing execution dialog. Confirm a flashing intensity of 2 and execute. Confirm that the emission current due to flashing is 20 to 40 μA. Insert the specimen holder in the specimen chamber of the S-4800 housing. Press [home] on the control panel to transfer the specimen holder to the observation position.

Click the acceleration voltage display area to open the HV setting dialog and set the acceleration voltage to [0.8 kV] and the emission current to [20 μA]. In the [base] tab of the operation panel, set signal selection to [SE]; select [upper (U)] and [+BSE] for the SE detector; and select [L.A. 100] in the selection box to the right of [+BSE] to go into the observation mode using the backscattered electron image. Similarly, in the [base] tab of the operation panel, set the probe current of the electron optical system condition block to [Normal]; set the focus mode to [UHR]; and set WD to [3.0 mm]. Press the [ON] button in the acceleration voltage display area of the control panel and apply the acceleration voltage.

(3) Calculation of the Number-Average Particle Diameter (D1) of the Magnetic Toner Set the magnification to 5000× (5 k) by dragging within the magnification indicator area of the control panel. Turn the [COARSE] focus knob on the operation panel and perform adjustment of the aperture alignment where some degree of focus has been obtained. Click [Align] in the control panel and display the alignment dialog and select [beam]. Migrate the displayed beam to the center of the concentric circles by turning the STIGMA/ALIGNMENT knobs (X, Y) on the operation panel. Then select [aperture] and turn the STIGMA/ALIGNMENT knobs (X, Y) one at a time and adjust so as to stop the motion of the image or minimize the motion. Close the aperture dialog and focus with the autofocus. Focus by repeating this operation an additional two times.

After this, determine the number-average particle diameter (D1) by measuring the particle diameter at 300 magnetic toner particles. The particle diameter of the individual particle is taken to be the maximum diameter when the magnetic toner particle is observed.

(4) Focus Adjustment

For particles with a number-average particle diameter (D1) obtained in (3) of ±0.1 μm, with the center of the maximum diameter adjusted to the center of the measurement screen, drag within the magnification indication area of the control panel to set the magnification to 10000× (10 k). Turn the [COARSE] focus knob on the operation panel and perform adjustment of the aperture alignment where some degree of focus has been obtained. Click [Align] in the control panel and display the alignment dialog and select [beam]. Migrate the displayed beam to the center of the concentric circles by turning the STIGMA/ALIGNMENT knobs (X, Y) on the operation panel. Then select [aperture] and turn the STIGMA/ALIGNMENT knobs (X, Y) one at a time and adjust so as to stop the motion of the image or minimize the motion. Close the aperture dialog and focus using autofocus. Then set the magnification to 50000× (50 k); carry out focus adjustment as above using the focus knob and the STIGMA/ALIGNMENT knob; and re-focus using autofocus. Focus by repeating this operation. Here, because the accuracy of the coverage ratio measurement is prone to decline when the observation plane has a large tilt angle, carry out the analysis by making a selection with the least tilt in the surface by making a selection during focus adjustment in which the entire observation plane is simultaneously in focus.

(5) Image Capture

Carry out brightness adjustment using the ABC mode and take a photograph with a size of 640×480 pixels and store. Carry out the analysis described below using this image file. Take one photograph for each magnetic toner particle and obtain images for at least 30 magnetic toner particles.

(6) Image Analysis

The coverage ratio A is calculated in the present invention using the analysis software indicated below by subjecting the image obtained by the above-described procedure to binarization processing. When this is done, the above-described single image is divided into 12 squares and each is analyzed. However, when an inorganic fine particle with a particle diameter greater than or equal to 50 nm is present within a partition, calculation of the coverage ratio A is not performed for this partition.

The analysis conditions with the Image-Pro Plus ver. 5.0 image analysis software are as follows.

Software: Image-ProPlus5.1J

From "measurement" in the tool-bar, select "count/size" and then "option" and set the binarization conditions. Select 8 links in the object extraction option and set smoothing to 0. In addition, preliminary screening, fill vacancies, and envelope are not selected and the "exclusion of boundary line" is set to "none". Select "measurement items" from "measurement" in the tool-bar and enter 2 to $10^7$ for the area screening range.

The coverage ratio is calculated by marking out a square zone. Here, the area (C) of the zone is made 24000 to 26000 pixels. Automatic binarization is performed by "processing"-binarization and the total area (D) of the silica-free zone is calculated.

The coverage ratio a is calculated using the following formula from the area C of the square zone and the total area D of the silica-free zone.

$$\text{coverage ratio } a(\%)=100-(D/C\times 100)$$

As noted above, calculation of the coverage ratio a is carried out for at least 30 magnetic toner particles. The average value of all the obtained data is taken to be the coverage ratio A of the present invention.

<the Coefficient of Variation on the Coverage Ratio A>

The coefficient of variation on the coverage ratio A is determined in the present invention as follows. The coefficient of variation on the coverage ratio A is obtained using the following formula letting σ(A) be the standard deviation on all the coverage ratio data used in the calculation of the coverage ratio A described above.

$$\text{coefficient of variation}(\%)=\{\sigma(A)/A\}\times 100$$

<Calculation of the Coverage Ratio B>

The coverage ratio B is calculated by first removing the unfixed inorganic fine particles on the magnetic toner surface and thereafter carrying out the same procedure as followed for the calculation of the coverage ratio A.

(1) Removal of the Unfixed Inorganic Fine Particles

The unfixed inorganic fine particles are removed as described below. The present inventors investigated and then set these removal conditions in order to thoroughly remove the inorganic fine particles other than those embedded in the toner surface.

Figure 9:
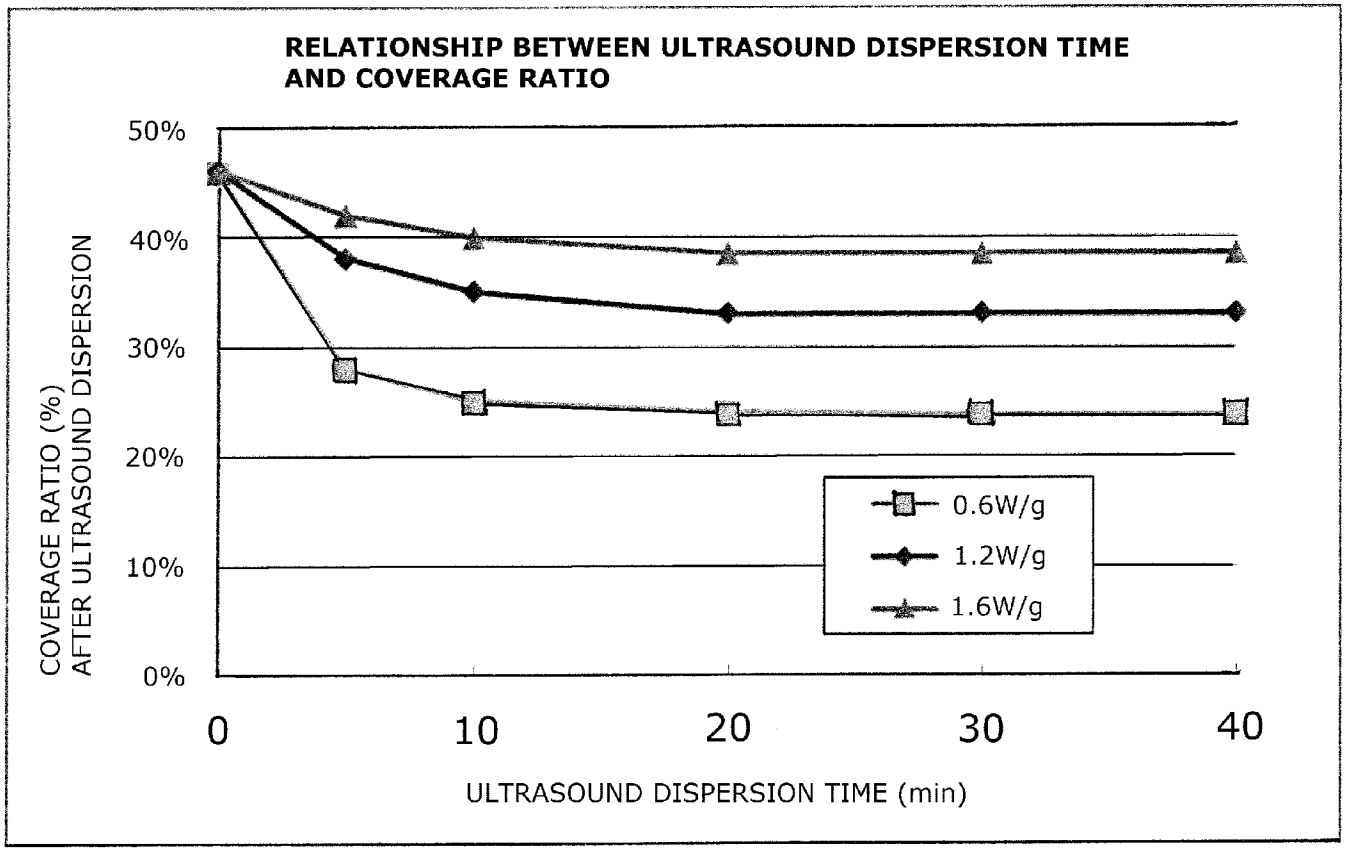
FIG. 9 is a diagram that shows an example of the relationship between the ultrasound dispersion time and the coverage ratio.

As an example, FIG. 9 shows the relationship between the ultrasound dispersion time and the coverage ratio calculated post-ultrasound dispersion, for magnetic toners in which the coverage ratio A was brought to 46% using the apparatus shown in FIG. 6 at three different external addition intensities. FIG. 9 was constructed by calculating, using the same procedure as for the calculation of coverage ratio A as described above, the coverage ratio of a magnetic toner provided by removing the inorganic fine particles by ultrasound dispersion by the method described below and then drying.

FIG. 9 demonstrates that the coverage ratio declines in association with removal of the inorganic fine particles by ultrasound dispersion and that, for all of the external addition intensities, the coverage ratio is brought to an approximately constant value by ultrasound dispersion for 20 minutes. Based on this, ultrasound dispersion for 30 minutes was regarded as providing a thorough removal of the inorganic fine particles other than the inorganic fine particles embedded in the toner surface and the thereby obtained coverage ratio was defined as coverage ratio B.

Considered in greater detail, 16.0 g of water and 4.0 g of Contaminon N (a neutral detergent from Wako Pure Chemical Industries, Ltd., product No. 037-10361) are introduced into a 30 mL glass vial and are thoroughly mixed. 1.50 g of the magnetic toner is introduced into the resulting solution and the magnetic toner is completely submerged by applying a magnet at the bottom. After this, the magnet is moved around in order to condition the magnetic toner to the solution and remove air bubbles.

The tip of a UH-50 ultrasound oscillator (from SMT Co., Ltd., the tip used is a titanium alloy tip with a tip diameter ϕ of 6 mm) is inserted so it is in the center of the vial and resides at a height of 5 mm from the bottom of the vial, and the inorganic fine particles are removed by ultrasound dispersion. After the application of ultrasound for 30 minutes, the entire amount of the magnetic toner is removed and dried. During this time, as little heat as possible is applied while carrying out vacuum drying at not more than 30° C.

(2) Calculation of the Coverage Ratio B

After the drying as described above, the coverage ratio of the magnetic toner is calculated as for the coverage ratio A described above, to obtain the coverage ratio B.

<Method of Measuring the Number-Average Particle Diameter of the Primary Particles of the Inorganic Fine Particles>

The number-average particle diameter of the primary particles of the inorganic fine particles is calculated from the inorganic fine particle image on the magnetic toner surface taken with Hitachi's S-4800 ultrahigh resolution field emission scanning electron microscope (Hitachi High-Technologies Corporation). The conditions for image acquisition with the S-4800 are as follows.

The same steps (1) to (3) as described above in "Calculation of the coverage ratio A" are carried out; focusing is performed by carrying out focus adjustment at a 50000× magnification of the magnetic toner surface as in (4); and the brightness is then adjusted using the ABC mode. This is followed by bringing the magnification to 100000×; performing focus adjustment using the focus knob and STIGMA/ALIGNMENT knobs as in (4); and focusing using autofocus. The focus adjustment process is repeated to achieve focus at 100000×.

After this, the particle diameter is measured on at least 300 inorganic fine particles on the magnetic toner surface and the primary particle number-average particle diameter (D1) is determined. Here, because the inorganic fine particles are also present as aggregates, the maximum diameter is determined on what can be identified as the primary particle, and the primary particle number-average particle diameter (D1) is obtained by taking the arithmetic average of the obtained maximum diameters.

<Method for Measuring the Weight-Average Particle Diameter (D4) of the Magnetic Toner>

The weight-average particle diameter (D4) of the magnetic toner is calculated as follows. The measurement instrument used is a "Coulter Counter Multisizer 3" (registered trademark, from Beckman Coulter, Inc.), a precision particle size distribution measurement instrument operating on the pore electrical resistance principle and equipped with a 100 μm aperture tube. The measurement conditions are set and the measurement data are analyzed using the accompanying dedicated software, i.e., "Beckman Coulter Multisizer 3 Version 3.51" (from Beckman Coulter, Inc.). The measurements are carried at 25000 channels for the number of effective measurement channels.

The aqueous electrolyte solution used for the measurements is prepared by dissolving special-grade sodium chloride in ion-exchanged water to provide a concentration of about 1 mass % and, for example, "ISOTON II" (from Beckman Coulter, Inc.) can be used.

The dedicated software is configured as follows prior to measurement and analysis.

In the "modify the standard operating method (SOM)" screen in the dedicated software, the total count number in the control mode is set to 50000 particles; the number of measurements is set to 1 time; and the Kd value is set to the value obtained using "standard particle 10.0 μm" (from Beckman Coulter, Inc.). The threshold value and noise level are automatically set by pressing the "threshold value/noise level measurement button". In addition, the current is set to 1600 μA; the gain is set to 2; the electrolyte is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to from 2 μm to 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube have previously been removed by the "aperture flush" function of the dedicated software.

(2) Approximately 30 mL of the above-described aqueous electrolyte solution is introduced into a 100-mL flatbottom glass beaker. To this is added as dispersant about 0.3 mL of a dilution prepared by the approximately three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System Tetora 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. Approximately 3.3 L of ion-exchanged water is introduced into the water tank of this ultrasound disperser and approximately 2 mL of Contaminon N is added to the water tank.

(4) The beaker described in (2) is set into the beaker holder opening on the ultrasound disperser and the ultrasound disperser is started. The height of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of toner is added to the aqueous electrolyte solution in small aliquots and dispersion is carried out. The ultrasound dispersion treatment is continued for an additional 60 seconds. The water temperature in the water bath is controlled as appropriate during ultrasound dispersion to be at least 10° C. and not more than 40° C.

(6) Using a pipette, the dispersed toner-containing aqueous electrolyte solution prepared in (5) is dripped into the round-bottom beaker set in the sample stand as described in (1) with adjustment to provide a measurement concentration of about 5%. Measurement is then performed until the number of measured particles reaches 50000.

(7) The measurement data is analyzed by the previously cited dedicated software provided with the instrument and the weight-average particle diameter (D4) is calculated. When set to graph/volume % with the dedicated software, the "average diameter" on the "analysis/volumetric statistical value (arithmetic average)" screen is the weight-average particle diameter (D4).

<Method of Measuring the Softening Temperature (Ts) of the Magnetic Toner and the Softening Point (Tm) of the Magnetic Toner>

Figure 10:
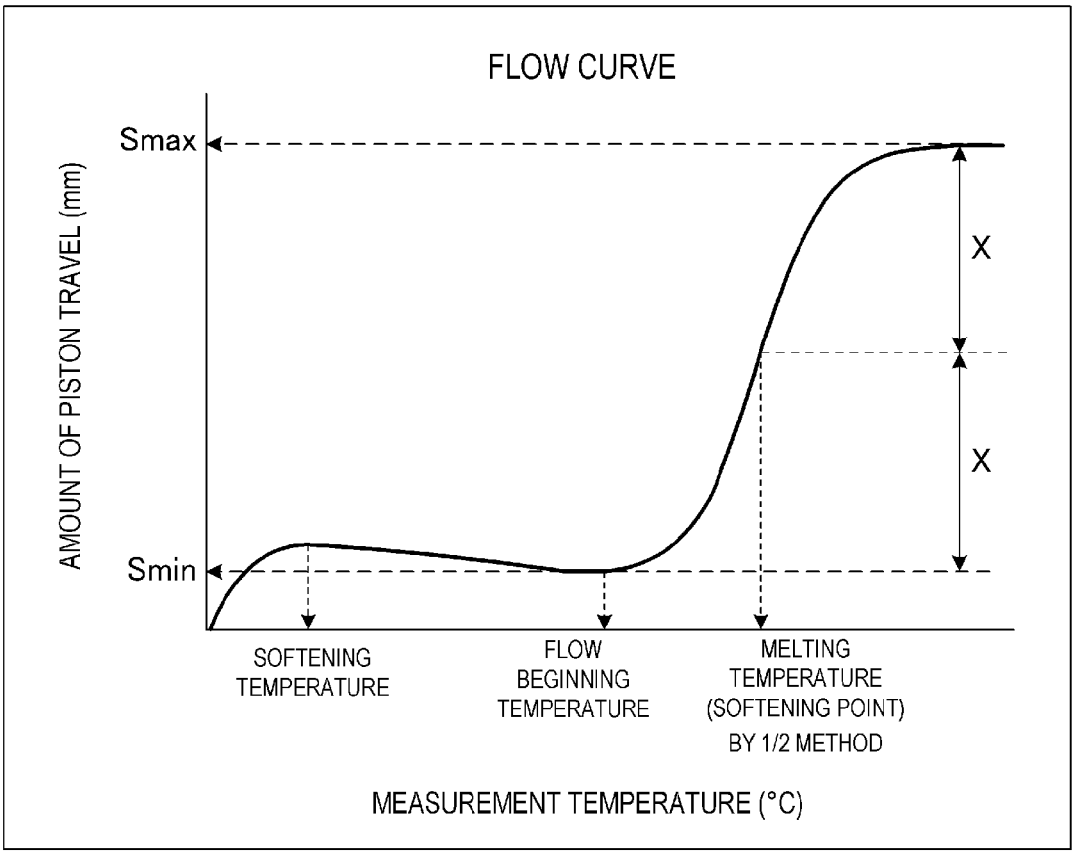
FIG. 10 is a model diagram of the flow curve of a magnetic toner as measured using a constant-load extrusion-type capillary rheometer.

Measurement of the softening temperature (Ts) and the softening point (Tm) of the magnetic toner is performed according to the manual provided with the instrument, using a "Flowtester CFT-500D Flow Property Evaluation Instrument", a constant-load extrusion-type capillary rheometer from Shimadzu Corporation. With this instrument, while a constant load is applied by a piston from the top of the measurement sample, the measurement sample filled in a cylinder is heated and melted and the melted measurement sample is extruded from a die at the bottom of the cylinder; a flow curve showing the relationship between the amount of piston travel and temperature can be obtained from this (a model diagram of the flow curve is shown in FIG. 10).

In the present invention, the softening temperature (Ts) is the temperature at the time point at which the amount of piston travel S moves in the direction of decrease. The decrease in the amount of piston travel is due to an expansion in volume caused by the melting of the magnetic toner that is the measurement sample.

For the softening point (Tm), on the other hand, the "melting temperature by the ½ method", as described in the manual provided with the "Flowtester CFT-500D Flow Property Evaluation Instrument", is used as the softening point (Tm). The melting temperature by the ½ method is determined as follows. First, ½ of the difference between Smax, which is the amount of piston travel at the completion of outflow, and Smin, which is the amount of piston travel at the start of outflow, is determined (This is designated as X. X=(Smax−Smin)/2). The temperature in the flow curve when the amount of piston travel in the flow curve reaches the sum of X and Smin is the melting temperature by the ½ method.

The measurement sample is prepared by subjecting approximately 1.5 g of the toner to compression molding for approximately 60 seconds at approximately 10 MPa in a 25° C. environment using a tablet compression molder (The NT-100H from NPa System Co., Ltd.) to provide a cylindrical shape with a diameter of approximately 8 mm.

The measurement conditions with the Flowtester CFT-500D are as follows.

test mode: rising temperature method
start temperature: 35° C.
saturated temperature: 200° C.
measurement interval: 1.0° C.
rate of temperature rise: 4.0° C./min
piston cross section area: 1.000 $cm^2$
test load (piston load): 10.0 kgf (0.9807 MPa)
preheating time: 300 seconds
diameter of die orifice: 1.0 mm
die length: 1.0 mm <Method for Measuring the Glass-Transition Temperature (Tg) of the Magnetic Toner and the Peak Temperature of the Endothermic Peak for the Magnetic Toner>

The glass-transition temperature (Tg) of the magnetic toner and the peak temperature of the endothermic peak for the magnetic toner are measured based on ASTM D3418-82 using a "Q1000" differential scanning calorimeter (TA Instruments, Inc.).

Temperature correction in the instrument detection section is carried out using the melting points of indium and zinc, while the heat of fusion of indium is used to correct the amount of heat.

10 mg of the magnetic toner is precisely weighed out for the measurement sample.

This is introduced into an aluminum pan. Using an empty aluminum pan as the reference, the measurement is performed at normal temperature and normal humidity at a rate of temperature rise of 10° C./min in the measurement temperature range from 30 to 200° C.

The change in the specific heat in the temperature range from 40° C. to 100° C. is obtained in this temperature ramp-up process. Here, the glass-transition temperature (Tg) of the magnetic toner is taken to be the intersection between the differential heat curve and the line for the midpoint between the baseline prior to the appearance of the specific heat change and the baseline after the appearance of the specific heat change.

In this measurement, on the other hand, the temperature is raised to 200° C. at a rate of temperature rise of 10° C./min and is then dropped to 30° C. at 10° C./min and is thereafter raised again at a rate of temperature rise of 10° C./min. The maximum endothermic peak is obtained in the temperature range from 40 to 120° C. in this second temperature ramp-up step.

This maximum endothermic peak is taken to be the endothermic peak for the magnetic toner. In addition, the peak temperature of the maximum endothermic peak is taken to be the peak temperature of the endothermic peak for the magnetic toner.

<Method of Measuring the Melting Point of the Release Agent>

The "melting point" of the release agent is measured based on ASTM D3418-82 using a DSC-7 (PerkinElmer Inc.) differential scanning calorimeter (DSC measurement instrument).

Specifically, 10 mg of the measurement sample is precisely weighed out and placed in an aluminum pan and the measurement is carried out at normal temperature and normal humidity at a rate of temperature rise of 10° C./min in the measurement range of 30 to 200° C. using an empty aluminum pan as the reference. The measurement is performed by raising the temperature to 200° C. at a rate of temperature rise of 10° C./min, then lowering the temperature to 30° C. at 10° C./min, and thereafter raising the temperature once again at a rate of temperature rise of 10° C./min. The peak temperature of the maximum endothermic peak obtained in this second temperature ramp-up step is taken to be the melting point of the release agent.

<Method for Measuring the Molecular Weight Distribution of the Tetrahydrofuran (THF)-Soluble Matter of the Magnetic Toner>

The molecular weight distribution of the tetrahydrofuran (THF)-soluble matter of the magnetic toner is measured using gel permeation chromatography (GPC) under the following conditions.

The column is stabilized in a heated chamber at 40° C., and tetrahydrofuran (THF) is introduced as solvent at a flow rate of 1 mL per minute into the column at this temperature. For the column, a combination of a plurality of commercially available polystyrene gel columns is favorably used to accurately measure the molecular weight range from $1\times10^3$ to $2\times10^6$. Examples here are the combination of Shodex GPC KF-801, 802, 803, 804, 805, 806, 807, and 800P from Showa Denko Kabushiki Kaisha and the combination of TSKgel G1000H(HXL), G2000H(HXL), G3000H(HXL), G4000H (HXL), G5000H(HXL), G6000H(HXL), G7000H(HXL), and TSKguard column from Tosoh Corporation. A 7-column train of Shodex KF-801, 802, 803, 804, 805, 806, and 807 from Showa Denko Kabushiki Kaisha is used in the present invention.

On the other hand, the magnetic toner is dispersed and dissolved in THF and allowed to stand overnight and is then filtered on a sample treatment filter (MyShoriDisk H-25-2 with a pore size of 0.2 to 0.5 μm (Tosoh Corporation)) and the filtrate is used as the sample. 50 to 200 μL of the THF solution of the magnetic toner, which has been adjusted to bring the resin component to 0.5 to 5 mg/mL for the sample concentration, is injected to carry out the measurement. An RI (refractive index) detector is used for the detector.

To measure the molecular weight of the sample, the molecular weight distribution possessed by the sample is calculated from the relationship between the number of counts and the logarithmic value on a calibration curve constructed using several different monodisperse polystyrene standard samples. The standard polystyrene samples used to construct the calibration curve are samples with molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ from the Pressure Chemical Company or Tosoh Corporation, and standard polystyrene samples at approximately 10 or more points are used.

Here, the main peak is the highest peak obtained in the range from a molecular weight of at least $5\times10^3$ to not more than $1\times10^4$ in the obtained molecular weight distribution, and the value of the molecular weight at this point is defined as the main peak molecular weight ($M_A$). In addition, the sub peak is the highest peak obtained in the range from a molecular weight of at least $1\times10^5$ to not more than $5\times10^5$, and the value of the molecular weight at this point is taken to be the sub peak molecular weight ($M_B$). Using the minimum value ($M_{Min}$) present between the main peak ($M_A$) and the sub peak ($M_B$), $S_A$ is taken to be the area of the molecular weight distribution curve from a molecular weight of 400 to the minimum value ($M_{Min}$) and $S_B$ is taken to be the area of the molecular weight distribution curve from the minimum value ($M_{Min}$) to a molecular weight of $5\times10^6$. To determine $S_A$ and $S_B$, the GPC chromatograms were cut out, the weight ratio was calculated, the mass % for the THF-insoluble matter was subtracted, and the area ratio was calculated. The percentage (%) for $S_A$ with respect to the sum total area of the obtained $S_A$ and $S_B$ is also determined.

Examples

The present invention is described in additional detail through the examples and comparative examples provided below, but the present invention is in no way restricted to these. The % and number of parts in the examples and comparative examples, unless specifically indicated otherwise, are in all instances on a mass basis.

<Low Molecular Weight Polymer A-1 Production Example>

A solution of a low molecular weight polymer A-1 was obtained by introducing 300 mass parts of xylene into a four-neck flask; heating under reflux; and carrying out the dropwise addition of a mixture of 85 mass parts of styrene, 15 mass parts of n-butyl acrylate, and 5.0 mass parts of di(secondary-butyl) peroxydicarbonate as a polymerization initiator over 5 hours.

<Low Molecular Weight Polymer A-2 to A-10 Production Examples>

Solutions of low molecular weight polymer A-2 to A-10 were obtained proceeding as in the production of low molecular weight polymer A-1, but changing the polymerizable monomer ratio and amount of polymerization initiator to that given in Table 1.

<High Molecular Weight Polymer B-1 Production Example>

180 mass parts of degassed water and 20 mass parts of a 2 mass % aqueous solution of a polyvinyl alcohol were introduced into a four-neck flask, followed by the addition of a mixture of 75 mass parts of styrene, 25 mass parts of n-butyl acrylate, 0.1 mass parts of divinylbenzene as a crosslinking agent, and 3.0 mass parts of benzoyl peroxide as a polymerization initiator and stirring to prepare a suspension. The interior of the flask was thoroughly replaced with nitrogen, followed by heating to 85° C. and polymerization; the polymerization of the high molecular weight polymer (B-1) was completed by holding for 24 hours.

<High Molecular Weight Polymer B-2 and B-3 Production Examples>

High molecular weight polymers B-2 and B-3 were obtained proceeding as for high molecular weight polymer B-1, but changing the type and amount of the polymerization initiator to that shown in Table 2 and, after the holding for 24 hours at 85° C., making a supplementary addition of 1.0 mass part of benzoyl peroxide and holding for an additional 12 hours.

<Binder Resin 1 Production Example>

20 mass parts of high molecular weight polymer B-1 was introduced into 323 mass parts of the solution of low molecular weight polymer A-1 (contained 80 mass parts of low molecular weight polymer A-1) and thorough mixing was performed under reflux. The organic solvent was then distilled off to obtain a binder resin 1. The properties of binder resin 1 are shown in Table 3.

<Binder Resin 2 to 19 Production Examples>

Binder resins 2 to 19 were obtained proceeding as in the Binder Resin 1 Production Example, but using the type and amount of low molecular weight polymer and high molecular weight polymer shown in Table 3. The properties of binder resins 2 to 19 are shown in Table 3.

<Magnetic Toner Particle 1 Production Example>

| | |
|---|---|
| binder resin 1 shown in Table 3 (refer to Table 1 and Table 2 for the composition of binder resin 1) | 100 mass parts |
| magnetic body (composition: $Fe_3O_4$, shape: spherical, primary particle number-average particle diameter: 0.21 μm, magnetic characteristics for 795.8 kA/m: $H_c$ = 5.5 kA/m, $\sigma_s$ = 84.0 $Am^2/kg$, and $\sigma_r$ = 6.4 $Am^2/kg$) | 95 mass parts |
| release agent 1 shown in Table 4 | 5 mass parts |
| iron complex of monoazo dye (T-77: Hodogaya Chemical Co., Ltd.) | 2 mass parts |

The starting materials listed above were preliminarily mixed using an FM10C Henschel mixer (Mitsui Miike Chemical Engineering Machinery Co., Ltd.). This was followed by kneading with a twin-screw kneader/extruder (PCM-30, Ikegai Ironworks Corporation) set at a rotation rate of 250 rpm with the set temperature being adjusted to provide a direct temperature in the vicinity of the outlet for the kneaded material of 145° C. The resulting melt-kneaded material was cooled; the cooled melt-kneaded material was coarsely pulverized with a cutter mill; the resulting coarsely pulverized material was finely pulverized using a Turbo Mill T-250 (Turbo Kogyo Co., Ltd.) at a feed rate of 25 kg/hr with the air temperature adjusted to provide an exhaust gas temperature of 38° C.; and classification was performed using a Coanda effect-based multifraction classifier to obtain a magnetic toner particle 1 having a weight-average particle diameter (D4) of 7.8 μm.

TABLE 1

| | Polymerizable monomer | | Initiator di(secondary-butyl) |
|---|---|---|---|
| Low molecular weight polymer | styrene (mass parts) | n-butyl acrylate (mass parts) | peroxydicarbonate (mass parts) |
| A-1 | 85 | 15 | 5.0 |
| A-2 | 80 | 20 | 4.0 |
| A-3 | 78 | 22 | 3.5 |
| A-4 | 82 | 18 | 3.5 |
| A-5 | 84 | 16 | 3.5 |
| A-6 | 87 | 13 | 3.5 |
| A-7 | 65 | 35 | 3.5 |
| A-8 | 63 | 37 | 3.5 |
| A-9 | 70 | 30 | 6.0 |
| A-10 | 87 | 13 | 3.0 |

TABLE 2

| | Polymerizable monomer | | | | Cross- |
|---|---|---|---|---|---|
| High molecular weight polymer | styrene (mass parts) | n-butyl acrylate (mass parts) | Initiator Type | (mass parts) | linking agent divinyl benzene |
| B-1 | 75 | 25 | benzoyl peroxide | 3.0 | 0.1 |
| B-2 | 75 | 25 | 2,2-bis(4,4-di-tert-butyl-peroxycyclohexyl) propane | 3.0 | 0.1 |
| B-3 | 75 | 25 | 2,2-bis(4,4-di-tert-butyl-peroxycyclohexyl) propane | 2.5 | 0.1 |

TABLE 3

| | Low molecular weight polymer | | High molecular weight polymer | | Peak | Glass- |
|---|---|---|---|---|---|---|
| Binder resin | Type | (mass parts) | Type | (mass parts) | molecular weight | transition temperature (° C.) |
| Binder resin 1 | A-1 | 80 | B-1 | 20 | $6.2 \times 10^3$ | 52.5 |
| Binder resin 2 | A-1 | 72 | B-1 | 28 | $6.0 \times 10^3$ | 52.0 |
| Binder resin 3 | A-1 | 70 | B-1 | 30 | $6.0 \times 10^3$ | 52.0 |
| Binder resin 4 | A-1 | 68 | B-1 | 32 | $5.8 \times 10^3$ | 51.9 |
| Binder resin 5 | A-1 | 68 | B-2 | 32 | $5.8 \times 10^3$ | 52.0 |
| Binder resin 6 | A-1 | 68 | B-3 | 32 | $5.8 \times 10^3$ | 52.1 |
| Binder resin 7 | A-2 | 68 | B-3 | 32 | $1.0 \times 10^4$ | 53.0 |
| Binder resin 8 | A-3 | 68 | B-3 | 32 | $1.2 \times 10^4$ | 53.3 |
| Binder resin 9 | A-4 | 68 | B-3 | 32 | $1.2 \times 10^4$ | 54.9 |
| Binder resin 10 | A-5 | 68 | B-3 | 32 | $1.2 \times 10^4$ | 56.0 |
| Binder resin 11 | A-7 | 68 | B-3 | 32 | $1.2 \times 10^4$ | 45.2 |
| Binder resin 12 | A-8 | 68 | B-3 | 32 | $1.2 \times 10^4$ | 44.3 |
| Binder resin 13 | A-8 | 60 | B-3 | 40 | $1.2 \times 10^4$ | 44.4 |
| Binder resin 14 | A-3 | 100 | — | — | $1.2 \times 10^4$ | 53.0 |

TABLE 3-continued

| | Low molecular weight polymer | | High molecular weight polymer | | Peak | Glass- |
|---|---|---|---|---|---|---|
| Binder resin | Type | (mass parts) | Type | (mass parts) | molecular weight | transition temperature (° C.) |
| Binder resin 15 | A-6 | 68 | B-3 | 32 | $1.2 \times 10^4$ | 58.7 |
| Binder resin 16 | A-10 | 80 | B-1 | 20 | $1.4 \times 10^4$ | 59.5 |
| Binder resin 17 | A-9 | 80 | B-1 | 20 | $5.1 \times 10^3$ | 44.0 |
| Binder resin 18 | A-1 | 55 | B-3 | 45 | $6.3 \times 10^3$ | 52.5 |
| Binder resin 19 | A-2 | 100 | — | — | $9.8 \times 10^3$ | 52.8 |

TABLE 4

| Release agent | Type | Substance | Melting point (° C.) |
|---|---|---|---|
| Release agent 1 | monoester wax | behenyl behenate | 68.0 |
| Release agent 2 | monoester wax | stearyl stearate | 61.0 |
| Release agent 3 | monoester wax | palmityl palmitate | 55.3 |
| Release agent 4 | monoester wax | myristyl myristate | 43.2 |
| Release agent 5 | diester wax | nonanediol dibehenate | 76.2 |
| Release agent 6 | diester wax | dibehenyl sebacate | 73.4 |
| Release agent 7 | diester wax | distearyl terephthalate | 85.1 |
| Release agent 8 | diester wax | dibehenyl terephthalate | 92.0 |
| Release agent 9 | triester wax | glycerin tribehenate | 70.6 |
| Release agent 10 | paraffin wax | polypropylene | 64.0 |

<Production of Magnetic Toner Particles 2 to 28>

Magnetic toner particles 2 to 28 were obtained proceeding as in the Magnetic Toner Particle 1 Production Example, but changing the binder resin and release agent as in Table 5.

TABLE 5

| Magnetic toner particle No. | Binder resin | Release agent | Weight-average particle diameter D4 (μm) |
|---|---|---|---|
| 1 | Binder resin 1 | Release agent 1 | 7.8 |
| 2 | Binder resin 2 | Release agent 1 | 7.8 |
| 3 | Binder resin 3 | Release agent 1 | 7.7 |
| 4 | Binder resin 4 | Release agent 1 | 7.8 |
| 5 | Binder resin 5 | Release agent 1 | 7.6 |
| 6 | Binder resin 6 | Release agent 1 | 7.9 |
| 7 | Binder resin 7 | Release agent 1 | 7.8 |
| 8 | Binder resin 8 | Release agent 1 | 7.8 |
| 9 | Binder resin 9 | Release agent 1 | 7.7 |
| 10 | Binder resin 10 | Release agent 1 | 7.8 |
| 11 | Binder resin 11 | Release agent 1 | 7.6 |
| 12 | Binder resin 12 | Release agent 1 | 7.8 |
| 13 | Binder resin 10 | Release agent 5 | 8.0 |
| 14 | Binder resin 10 | Release agent 6 | 7.7 |
| 15 | Binder resin 10 | Release agent 7 | 7.8 |
| 16 | Binder resin 10 | Release agent 2 | 7.8 |
| 17 | Binder resin 10 | Release agent 8 | 7.8 |
| 18 | Binder resin 10 | Release agent 3 | 7.9 |
| 19 | Binder resin 13 | Release agent 1 | 7.8 |
| 20 | Binder resin 14 | Release agent 1 | 7.8 |
| 21 | Binder resin 17 | Release agent 3 | 7.7 |
| 22 | Binder resin 15 | Release agent 8 | 7.9 |
| 23 | Binder resin 1 | Release agent 9 | 7.7 |
| 24 | Binder resin 1 | Release agent 10 | 7.7 |

TABLE 5-continued

| Magnetic toner particle No. | Binder resin | Release agent | Weight-average particle diameter D4 (μm) |
|---|---|---|---|
| 25 | Binder resin 16 | Release agent 8 | 7.9 |
| 26 | Binder resin 17 | Release agent 4 | 7.8 |
| 27 | Binder resin 18 | Release agent 1 | 7.9 |
| 28 | Binder resin 19 | Release agent 1 | 7.8 |

<Magnetic Toner Particle 29 Production Example>

100 mass parts of magnetic toner particle 1 and 0.5 mass parts of silica fine particle 1 were introduced into an FM10C Henschel mixer (Mitsui Miike Chemical Engineering Machinery Co., Ltd.) and were mixed and stirred for 2 minutes at 3000 rpm. This silica fine particle 1 was obtained by treating 100 mass parts of a silica with a BET specific surface area of 130 $m^2/g$ and a primary particle number-average particle diameter (D1) of 16 nm with 10 mass parts of hexamethyldisilazane and then with 10 mass parts of dimethylsilicone oil.

This mixed and stirred material was then subjected to surface modification using a Meteorainbow (Nippon Pneumatic Mfg. Co., Ltd.), which is a device that carries out the surface modification of magnetic toner particles using a hot wind blast. The surface modification conditions were a starting material feed rate of 2 kg/hr, a hot wind flow rate of 700 L/min, and a hot wind ejection temperature of 300° C. Magnetic toner particle 29 was obtained by carrying out this hot wind treatment. Magnetic toner particle 29 had a weight-average particle diameter (D4) of 7.9 μm.

<Magnetic Toner Particle 30 Production Example>

A magnetic toner particle 30 was obtained proceeding as in the Magnetic Toner Particle 29 Production Example, but using 1.5 mass parts for the silica fine particle 1 added in the Magnetic Toner Particle 29 Production Example. Magnetic toner particle 30 had a weight-average particle diameter (D4) of 7.9 μm.

<Magnetic Toner 1 Production Example>

An external addition and mixing process was carried out using the apparatus shown in FIG. 6 on the magnetic toner particle 1 provided by Magnetic Toner Particle 1 Production Example.

In this example, which was followed by a main external addition using the apparatus shown in FIG. 6, in which the diameter of the inner circumference of the main casing 1 was 130 mm; the apparatus used had a volume for the processing space 9 of $2.0\times10^{-3}$ $m^3$; the rated power for the drive member 8 was 5.5 kW; and the stirring member 3 had the shape given in FIG. 7. The overlap width d in FIG. 7 between the stirring member 3*a* and the stirring member 3*b* was 0.25D with respect to the maximum width D of the stirring member 3, and the clearance between the stirring member 3 and the inner circumference of the main casing 1 was 3.0 mm.

100 mass parts (500 g) of magnetic toner particle 1 and 2.00 mass parts of the silica fine particle 1 were introduced into an apparatus shown in FIG. 6.

Silica fine particles 1 were obtained by treating 100 mass parts of a silica with a BET specific surface area of 130 $m^2/g$ and a primary particle number-average particle diameter (D1) of 16 nm with 10 mass parts hexamethyldisilazane and then with 10 mass parts dimethylsilicone oil.

A pre-mixing was carried out after the introduction of the magnetic toner particles and silica fine particle 1 in order to uniformly mix the magnetic toner particles and the silica fine particles. The pre-mixing conditions were as follows: a drive member 8 power of 0.1 W/g (drive member 8 rotation rate of 150 rpm) and a processing time of 1 minute.

The external addition and mixing process was carried out once pre-mixing was finished. With regard to the conditions for the external addition and mixing process, the processing time was 5 minutes and the peripheral velocity of the outermost end of the stirring member 3 was adjusted to provide a constant drive member 8 power of 0.9 W/g (drive member 8 rotation rate of 1650 rpm). The conditions for the external addition and mixing process are shown in Table 6.

After the external addition and mixing process, the coarse particles and so forth were removed using a circular vibrating screen equipped with a screen having a diameter of 500 mm and an aperture of 75 μm to obtain magnetic toner 1. A value of 18 nm was obtained when magnetic toner 1 was submitted to magnification and observation with a scanning electron microscope and the number-average particle diameter of the primary particles of the silica fine particles on the magnetic toner surface was measured. The external addition conditions and properties of magnetic toner 1 are shown in Table 6 and Table 7, respectively.

<Magnetic Toner 2 to 25, Magnetic Toner 28 and 29, and Magnetic Toner 32 to 46 Production Examples>

Magnetic toners 2 to 25 and magnetic toners 28 and 29 and 32 to 46 were obtained using the magnetic toner particles shown in Table 6 in the Magnetic Toner 1 Production Example in place of magnetic toner particle and by performing respective external addition processing using the external addition formulations, external addition apparatuses, and external addition conditions shown in Table 6. The hybridizer referenced in Table 6 is the Hybridizer Model 5 (Nara Machinery Co., Ltd.). For magnetic toners 16 to 25 and magnetic toners 28 and 29, and 32 to 46, pre-mixing was not performed and the external addition and mixing process was carried out immediately after introduction (indicated by "no pre-mixing" in Table 6). In addition, anatase titanium oxide fine particles (BET specific surface area: 80 $m^2/g$, primary particle number-average particle diameter (D1): 15 nm, treated with 12 mass % isobutyltrimethoxysilane) were used for the titania fine particles referenced in Table 6 and alumina fine particles (BET specific surface area: 80 $m^2/g$, primary particle number-average particle diameter (D1): 17 nm, treated with 10 mass % isobutyltrimethoxysilane) were used for the alumina fine particles referenced in Table 6. Table 6 also gives the proportion (mass %) of silica fine particles for the addition of titania fine particles and/or alumina fine particles in addition to silica fine particles. The properties of the individual magnetic toners are given in Table 7.

<Magnetic Toner 26 Production Example>

A magnetic toner 26 was obtained by following the same procedure as in the Magnetic Toner 1 Production Example, with the exception that a silica fine particle 2 was used in place of the silica fine particle 1 in the Magnetic Toner 1 Production Example, magnetic toner particle 22 was used in place of magnetic toner particle 1, and external addition processing was performed using the external addition formulation, external addition apparatus, and external addition conditions shown in Table 6. Silica fine particle 2 was obtained by performing the same surface treatment as with silica fine particle 1, but on a silica that had a BET specific surface area of 200 $m^2/g$ and a primary particle number-average particle diameter (D1) of 12 nm. A value of 14 nm was obtained when magnetic toner 26 was submitted to magnification and observation with a scanning electron microscope and the number-average particle diameter of the primary particles of the silica fine particles on the magnetic toner surface was measured. The external addition conditions for magnetic toner 26 are shown in Table 6, and its properties are shown in Table 7.

<Magnetic Toner 27 Production Example>

A magnetic toner 27 was obtained by following the same procedure as in the Magnetic Toner 1 Production Example, with the exception that a silica fine particle 3 was used in place of the silica fine particle 1 in the Magnetic Toner 1 Production Example, magnetic toner particle 22 was used in place of magnetic toner particle 1, and external addition processing was performed using the external addition formulation, external addition apparatus, and external addition conditions shown in Table 6. Silica fine particle 3 was obtained by performing the same surface treatment as with silica fine particle 1, but on a silica that had a BET specific surface area of 90 $m^2/g$ and a primary particle number-average particle diameter (D1) of 25 nm. A value of 28 nm was obtained when magnetic toner 27 was submitted to magnification and observation with a scanning electron microscope and the number-average particle diameter of the primary particles of the silica fine particles on the magnetic toner surface was measured. The external addition conditions for magnetic toner 27 are shown in Table 6, and its properties are shown in Table 7.

<Magnetic Toner 30 Production Example>

The external addition and mixing process was performed according to the following procedure using the same apparatus structure (apparatus in FIG. 6) as in the Magnetic Toner 1 Production Example.

As shown in Table 6, the silica fine particle 1 (2.00 mass parts) added in the Magnetic Toner 1 Production Example was changed to silica fine particle (1.70 mass parts) and titania fine particles (0.30 mass parts) and magnetic toner particle 22 was used in place of magnetic toner particle 1.

First, 100 mass parts of magnetic toner particle 22 and 1.70 mass parts of silica fine particle 1 were introduced. Then, without carrying out pre-mixing, processing was performed for a processing time of 2 minutes while adjusting the peripheral velocity of the outermost end of the stirring member 3 so as to provide a constant drive member 8 power of 0.9 W/g (drive member 8 rotation rate of 1650 rpm), after which the mixing process was temporarily stopped. The supplementary introduction of the remaining titania fine particles (0.30 mass parts with reference to 100 mass parts of the magnetic toner particles) was then performed, followed by again processing for a processing time of 3 minutes while adjusting the peripheral velocity of the outermost end of the stirring member 3 so as to provide a constant drive member 8 power of 0.9 W/g (drive member 8 rotation rate of 1650 rpm), thus providing a total external addition and mixing process time of 5 minutes. After the external addition and mixing process, the coarse particles and so forth were removed using a circular vibrating screen as in the Magnetic Toner 1 Production Example to obtain magnetic toner 30. The external addition conditions for magnetic toner 30 are given in Table 6, and its properties are given in Table 7.

<Magnetic Toner 31 Production Example>

The external addition and mixing process was performed according to the following procedure using the same apparatus structure (apparatus in FIG. 6) as in the Magnetic Toner 1 Production Example.

As shown in Table 6, the silica fine particle 1 (2.00 mass parts) added in the Magnetic Toner 1 Production Example was changed to silica fine particle (1.70 mass parts) and titania fine particles (0.30 mass parts) and magnetic toner particle 22 was used in place of magnetic toner particle 1.

First, 100 mass parts of magnetic toner particle 22, 0.70 mass parts of silica fine particle 1, and 0.30 mass parts of the titania fine particles were introduced. Then, without carrying out pre-mixing, processing was performed for a processing time of 2 minutes while adjusting the peripheral velocity of the outermost end of the stirring member 3 so as to provide a constant drive member 8 power of 0.9 W/g (drive member 8 rotation rate of 1650 rpm), after which the mixing process was temporarily stopped. The supplementary introduction of the remaining silica fine particle 1 (1.00 mass part with reference to 100 mass parts of the magnetic toner particles) was then performed, followed by again processing for a processing time of 3 minutes while adjusting the peripheral velocity of the outermost end of the stirring member 3 so as to provide a constant drive member 8 power of 0.9 W/g (drive member 8 rotation rate of 1650 rpm), thus providing a total external addition and mixing process time of 5 minutes. After the external addition and mixing process, the coarse particles and so forth were removed using a circular vibrating screen as in the Magnetic Toner 1 Production Example to obtain magnetic toner 31. The external addition conditions for magnetic toner 31 are given in Table 6 and its properties are given in Table 7.

<Production of Comparative Magnetic Toners 1 to 17 and Comparative Magnetic Toners 19 to 24>

Comparative magnetic toners 1 to 17 and comparative magnetic toners 19 to 24 were obtained proceeding as in the Magnetic Toner 1 Production Example, but using the magnetic toner particles shown in Table 6 in place of magnetic toner particle 1 and performing the respective external addition processing using the external addition formulations, external addition apparatuses, and external addition conditions shown in Table 6. The Henschel mixer referenced in Table 6 is the FM10C (Mitsui Miike Chemical Engineering Machinery Co., Ltd.). The properties of the individual comparative magnetic toners are shown in Table 7.

<Comparative Magnetic Toner 18 Production>

A comparative magnetic toner 18 was obtained by following the same procedure as in Magnetic Toner 1 Production Example, with the exception that silica fine particle 4 was used in place of the silica fine particle 1 and addition conditions were modified as per Table 6. Silica fine particle 4 was obtained by performing the same surface treatment as with silica fine particle 1, but on a silica that had a BET specific area of 30 $m^2/g$ and a primary particle number-average particle diameter (D1) of 51 nm. A value of 53 nm was obtained when comparative magnetic toner 18 was submitted to magnification and observation with a scanning electron microscope and the number-average particle diameter of the primary particles of the silica fine particles on the magnetic toner surface was measured. The external addition conditions for comparative magnetic toner 18 are shown in Table 6 and its properties are shown in Table 7.

TABLE 6

| Magnetic toner No. | Magnetic toner particle No. | Silica fine particles (mass parts) | | Titania fine particles (mass parts) | Alumina fine particles (mass parts) | Content of silica fine particles (mass %) | Content of silica fine particles in the fixed inorganic fine particles (mass %) | External addition apparatus | Operating conditions for the external addition apparatus | Operating time by the external addition apparatus |
|---|---|---|---|---|---|---|---|---|---|---|
| 1 | 1 | silica fine particle 1 | 2.00 | — | — | 100 | 100 | FIG. 6 | 0.9 W/g (1650 rpm) | 5 min |
| 2 | 2 | silica fine particle 1 | 2.00 | — | — | 100 | 100 | FIG. 6 | 0.9 W/g (1650 rpm) | 5 min |
| 3 | 3 | silica fine particle 1 | 2.00 | — | — | 100 | 100 | FIG. 6 | 0.9 W/g (1650 rpm) | 5 min |

TABLE 6-continued

| | Magnetic toner particle No. | Silica fine particles (mass parts) | | Titania fine particles (mass parts) | Alumina fine particles (mass parts) | Content of silica fine particles (mass %) | Content of silica fine particles in the fixed inorganic fine particles (mass %) | External addition apparatus | Operating conditions for the external addition apparatus | Operating time by the external addition apparatus |
|---|---|---|---|---|---|---|---|---|---|---|
| 4 | 4 | silica fine particle 1 | 2.00 | — | — | 100 | 100 | FIG. 6 | 0.9 W/g (1650 rpm) | 5 min |
| 5 | 5 | silica fine particle 1 | 2.00 | — | — | 100 | 100 | FIG. 6 | 0.9 W/g (1650 rpm) | 5 min |
| 6 | 6 | silica fine particle 1 | 2.00 | — | — | 100 | 100 | FIG. 6 | 0.9 W/g (1650 rpm) | 5 min |
| 7 | 7 | silica fine particle 1 | 2.00 | — | — | 100 | 100 | FIG. 6 | 0.9 W/g (1650 rpm) | 5 min |
| 8 | 8 | silica fine particle 1 | 2.00 | — | — | 100 | 100 | FIG. 6 | 0.9 W/g (1650 rpm) | 5 min |
| 9 | 9 | silica fine particle 1 | 2.00 | — | — | 100 | 100 | FIG. 6 | 0.9 W/g (1650 rpm) | 5 min |
| 10 | 10 | silica fine particle 1 | 2.00 | — | — | 100 | 100 | FIG. 6 | 0.9 W/g (1650 rpm) | 5 min |
| 11 | 11 | silica fine particle 1 | 2.00 | — | — | 100 | 100 | FIG. 6 | 0.9 W/g (1650 rpm) | 5 min |
| 12 | 12 | silica fine particle 1 | 2.00 | — | — | 100 | 100 | FIG. 6 | 0.9 W/g (1650 rpm) | 5 min |
| 13 | 10 | silica fine particle 1 | 2.00 | — | — | 100 | 100 | FIG. 6 | 0.9 W/g (1650 rpm) | 4 min |
| 14 | 10 | silica fine particle 1 | 2.00 | — | — | 100 | 100 | Hybridizer | 6000 rpm | 5 min |
| 15 | 10 | silica fine particle 1 | 2.00 | — | — | 100 | 100 | Hybridizer | 7000 rpm | 5 min |
| 16 | 13 | silica fine particle 1 | 2.00 | — | — | 100 | 100 | FIG. 6 | no pre-mixing 0.9 W/g (1650 rpm) | 5 min |
| 17 | 14 | silica fine particle 1 | 2.00 | — | — | 100 | 100 | FIG. 6 | no pre-mixing 0.9 W/g (1650 rpm) | 5 min |
| 18 | 15 | silica fine particle 1 | 2.00 | — | — | 100 | 100 | FIG. 6 | no pre-mixing 0.9 W/g (1650 rpm) | 5 min |
| 19 | 16 | silica fine particle 1 | 2.00 | — | — | 100 | 100 | FIG. 6 | no pre-mixing 0.9 W/g (1650 rpm) | 5 min |
| 20 | 17 | silica fine particle 1 | 2.00 | — | — | 100 | 100 | FIG. 6 | no pre-mixing 0.9 W/g (1650 rpm) | 5 min |
| 21 | 18 | silica fine particle 1 | 2.00 | — | — | 100 | 100 | FIG. 6 | no pre-mixing 0.9 W/g (1650 rpm) | 5 min |
| 22 | 19 | silica fine particle 1 | 2.00 | — | — | 100 | 100 | FIG. 6 | no pre-mixing 0.9 W/g (1650 rpm) | 5 min |
| 23 | 20 | silica fine particle 1 | 2.00 | — | — | 100 | 100 | FIG. 6 | no pre-mixing 0.9 W/g (1650 rpm) | 5 min |
| 24 | 21 | silica fine particle 1 | 2.00 | — | — | 100 | 100 | FIG. 6 | no pre-mixing 0.9 W/g (1650 rpm) | 5 min |
| 25 | 22 | silica fine particle 1 | 2.00 | — | — | 100 | 100 | FIG. 6 | no pre-mixing 0.9 W/g (1650 rpm) | 5 min |
| 26 | 22 | silica fine particle 2 | 2.00 | — | — | 100 | 100 | FIG. 6 | no pre-mixing 0.9 W/g (1650 rpm) | 5 min |
| 27 | 22 | silica fine particle 3 | 2.00 | — | — | 100 | 100 | FIG. 6 | no pre-mixing 0.9 W/g (1650 rpm) | 5 min |
| 28 | 22 | silica fine particle 1 | 1.80 | — | — | 100 | 100 | FIG. 6 | no pre-mixing 0.9 W/g (1650 rpm) | 5 min |
| 29 | 22 | silica fine particle 1 | 1.70 | 0.30 | — | 85 | 85 | FIG. 6 | no pre-mixing 0.9 W/g (1650 rpm) | 5 min |
| 30 | 22 | silica fine particle 1 | 1.70 | 0.30 | — | 85 | 90 | FIG. 6 | no pre-mixing 0.9 W/g (1650 rpm) | 5 min |
| 31 | 22 | silica fine particle 1 | 1.70 | 0.30 | — | 85 | 80 | FIG. 6 | no pre-mixing 0.9 W/g (1650 rpm) | 5 min |
| 32 | 22 | silica fine particle 1 | 1.70 | 0.15 | 0.15 | 85 | 85 | FIG. 6 | no pre-mixing 0.9 W/g (1650 rpm) | 5 min |
| 33 | 22 | silica fine particle 1 | 1.50 | — | — | 100 | 100 | FIG. 6 | no pre-mixing 0.9 W/g (1650 rpm) | 5 min |
| 34 | 22 | silica fine particle 1 | 1.28 | 0.22 | — | 85 | 85 | FIG. 6 | no pre-mixing 0.9 W/g (1650 rpm) | 5 min |
| 35 | 22 | silica fine particle 1 | 1.28 | 0.12 | 0.10 | 85 | 85 | FIG. 6 | no pre-mixing 0.9 W/g (1650 rpm) | 5 min |
| 36 | 22 | silica fine particle 1 | 2.60 | — | — | 100 | 100 | FIG. 6 | no pre-mixing 0.9 W/g (1650 rpm) | 5 min |
| 37 | 22 | silica fine particle 1 | 2.25 | 0.35 | — | 87 | 87 | FIG. 6 | no pre-mixing 0.9 W/g (1650 rpm) | 5 min |
| 38 | 22 | silica fine particle 1 | 2.25 | 0.20 | 0.15 | 87 | 87 | FIG. 6 | no pre-mixing 0.9 W/g (1650 rpm) | 5 min |
| 39 | 22 | silica fine particle 1 | 2.00 | — | — | 100 | 100 | FIG. 6 | no pre-mixing 1.5 W/g (2450 rpm) | 5 min |
| 40 | 22 | silica fine particle 1 | 2.00 | — | — | 100 | 100 | FIG. 6 | no pre-mixing 0.6 W/g (1250 rpm) | 5 min |
| 41 | 22 | silica fine particle 1 | 1.50 | — | — | 100 | 100 | FIG. 6 | no pre-mixing 1.5 W/g (2450 rpm) | 5 min |
| 42 | 21 | silica fine particle 1 | 1.50 | — | — | 100 | 100 | FIG. 6 | no pre-mixing 1.5 W/g (2450 rpm) | 5 min |
| 43 | 22 | silica fine particle 1 | 1.50 | — | — | 100 | 100 | FIG. 6 | no pre-mixing 0.6 W/g (1250 rpm) | 5 min |
| 44 | 21 | silica fine particle 1 | 1.50 | — | — | 100 | 100 | FIG. 6 | no pre-mixing 0.6 W/g (1250 rpm) | 5 min |

TABLE 6-continued

| | Magnetic toner particle No. | Silica fine particles (mass parts) | | Titania fine particles (mass parts) | Alumina fine particles (mass parts) | Content of silica fine particles (mass %) | Content of silica fine particles in the fixed inorganic fine particles (mass %) | External addition apparatus | Operating conditions for the external addition apparatus | Operating time by the external addition apparatus |
|---|---|---|---|---|---|---|---|---|---|---|
| 45 | 22 | silica fine particle 1 | 2.60 | — | — | 100 | 100 | FIG. 6 | no pre-mixing 1.5 W/g (2450 rpm) | 5 min |
| 46 | 22 | silica fine particle 1 | 2.60 | — | — | 100 | 100 | FIG. 6 | no pre-mixing 0.6 W/g (1250 rpm) | 5 min |
| Comparative magnetic toner No. | | | | | | | | | | |
| 1 | 1 | silica fine particle 1 | 1.50 | — | — | 100 | 100 | Henschel mixer | 3000 rpm | 2 min |
| 2 | 1 | silica fine particle 1 | 1.50 | — | — | 100 | 100 | Henschel mixer | 4000 rpm | 5 min |
| 3 | 1 | silica fine particle 1 | 2.60 | — | — | 100 | 100 | Henschel mixer | 3000 rpm | 2 min |
| 4 | 1 | silica fine particle 1 | 2.60 | — | — | 100 | 100 | Henschel mixer | 4000 rpm | 5 min |
| 5 | 1 | silica fine particle 1 | 1.50 | — | — | 100 | 100 | Hybridizer | 6000 rpm | 8 min |
| 6 | 1 | silica fine particle 1 | 1.50 | — | — | 100 | 100 | Hybridizer | 7000 rpm | 8 min |
| 7 | 29 | silica fine particle 1 | 1.00 | — | — | 100 | 100 | Henschel mixer | 4000 rpm | 2 min |
| 8 | 29 | silica fine particle 1 | 2.00 | — | — | 100 | 100 | Henschel mixer | 4000 rpm | 2 min |
| 9 | 30 | silica fine particle 1 | 1.00 | — | — | 100 | 100 | Henschel mixer | 4000 rpm | 2 min |
| 10 | 30 | silica fine particle 1 | 2.00 | — | — | 100 | 100 | Henschel mixer | 4000 rpm | 2 min |
| 11 | 1 | silica fine particle 1 | 1.60 | 0.40 | — | 80 | 80 | FIG. 6 | 0.9 W/g (1650 rpm) | 5 min |
| 12 | 1 | silica fine particle 1 | 1.60 | 0.20 | 0.20 | 80 | 80 | FIG. 6 | 0.9 W/g (1650 rpm) | 5 min |
| 13 | 1 | silica fine particle 1 | 1.50 | — | — | 100 | 100 | FIG. 6 | no pre-mixing 0.6 W/g (1250 rpm) | 3 min |
| 14 | 1 | silica fine particle 1 | 1.20 | — | — | 100 | 100 | FIG. 6 | no pre-mixing 0.6 W/g (1250 rpm) | 3 min |
| 15 | 1 | silica fine particle 1 | 3.10 | — | — | 100 | 100 | FIG. 6 | no pre-mixing 0.9 W/g (1650 rpm) | 5 min |
| 16 | 1 | silica fine particle 1 | 2.60 | — | — | 100 | 100 | FIG. 6 | no pre-mixing 0.6 W/g (1250 rpm) | 3 min |
| 17 | 1 | silica fine particle 1 | 1.50 | — | — | 100 | 100 | FIG. 6 | no pre-mixing 1.5 W/g (2450 rpm) | 5 min |
| 18 | 1 | silica fine particle 4 | 2.00 | | | 100 | 100 | FIG. 6 | 1.5 W/g (2450 rpm) | 5 min |
| 19 | 23 | silica fine particle 1 | 2.00 | — | — | 100 | 100 | FIG. 6 | 0.9 W/g (1650 rpm) | 5 min |
| 20 | 24 | silica fine particle 1 | 2.00 | — | — | 100 | 100 | FIG. 6 | 0.9 W/g (1650 rpm) | 5 min |
| 21 | 25 | silica fine particle 1 | 2.00 | — | — | 100 | 100 | FIG. 6 | 0.9 W/g (1650 rpm) | 5 min |
| 22 | 26 | silica fine particle 1 | 2.00 | — | — | 100 | 100 | FIG. 6 | 0.9 W/g (1650 rpm) | 5 min |
| 23 | 27 | silica fine particle 1 | 2.00 | — | — | 100 | 100 | FIG. 6 | 0.9 W/g (1650 rpm) | 5 min |
| 24 | 28 | silica fine particle 1 | 2.00 | — | — | 100 | 100 | FIG. 6 | 0.9 W/g (1650 rpm) | 5 min |

TABLE 7

| | Magnetic toner particle No. | Flow tester: Softening temperature Ts (° C.) | Flow tester: Softening point Tm (° C.) | DSC: Endothermic peak (° C.) | DSC: Glass-transition temperature Tg (° C.) | GPC: Main peak molecular weight ($M_A$) | GPC: Sub peak molecular weight ($M_B$) | GPC: Sub peak area ($S_B$) ratio (%)/Main peak area ($S_A$) ratio (%) | Coverage ratio A (%) | Coverage ratio B (%) | B/A | Coefficient of variation on coverage ratio A (%) |
|---|---|---|---|---|---|---|---|---|---|---|---|---|
| Magnetic toner No. | | | | | | | | | | | | |
| 1 | 1 | 71.3 | 129.5 | 68.0 | 52.0 | $5.8 \times 10^3$ | $2.9 \times 10^5$ | 20/80 | 56.2 | 38.8 | 0.69 | 6.5 |
| 2 | 2 | 71.8 | 130.5 | 68.2 | 51.4 | $5.8 \times 10^3$ | $2.9 \times 10^5$ | 28/72 | 55.4 | 37.7 | 0.68 | 6.1 |
| 3 | 3 | 71.4 | 131.1 | 67.9 | 52.2 | $5.6 \times 10^3$ | $2.9 \times 10^5$ | 30/70 | 54.6 | 37.1 | 0.68 | 6.8 |
| 4 | 4 | 71.5 | 133.5 | 68.3 | 52.1 | $5.9 \times 10^3$ | $2.9 \times 10^5$ | 32/68 | 55.5 | 36.6 | 0.66 | 6.3 |
| 5 | 5 | 71.9 | 134.8 | 68.3 | 53.4 | $6.0 \times 10^3$ | $4.8 \times 10^5$ | 32/68 | 57.6 | 38.0 | 0.66 | 5.7 |
| 6 | 6 | 72.1 | 136.3 | 68.2 | 53.2 | $5.8 \times 10^3$ | $5.2 \times 10^5$ | 32/68 | 56.1 | 37.6 | 0.67 | 6.1 |
| 7 | 7 | 72.4 | 136.5 | 68.1 | 52.6 | $9.9 \times 10^3$ | $5.3 \times 10^5$ | 32/68 | 55.4 | 37.1 | 0.67 | 6.2 |
| 8 | 8 | 73.2 | 136.7 | 68.0 | 53.0 | $1.2 \times 10^4$ | $5.2 \times 10^5$ | 32/68 | 53.8 | 36.0 | 0.67 | 5.9 |
| 9 | 9 | 73.3 | 137.0 | 68.0 | 54.8 | $1.1 \times 10^4$ | $5.3 \times 10^5$ | 32/68 | 53.9 | 35.6 | 0.66 | 6.6 |
| 10 | 10 | 73.8 | 136.5 | 68.2 | 55.6 | $1.2 \times 10^4$ | $5.2 \times 10^5$ | 32/68 | 54.4 | 37.0 | 0.68 | 5.7 |
| 11 | 11 | 65.1 | 126.2 | 68.0 | 45.6 | $1.2 \times 10^4$ | $5.2 \times 10^5$ | 32/68 | 57.2 | 37.8 | 0.66 | 6.2 |
| 12 | 12 | 64.2 | 125.0 | 68.1 | 44.8 | $1.3 \times 10^4$ | $5.2 \times 10^5$ | 32/68 | 55.1 | 37.5 | 0.68 | 6.4 |

TABLE 7-continued

| | Magnetic toner particle No. | Flow tester: Softening temperature Ts (° C.) | Flow tester: Softening point Tm (° C.) | DSC: Endothermic peak (° C.) | DSC: Glass-transition temperature Tg (° C.) | GPC: Main peak molecular weight ($M_A$) | GPC: Sub peak molecular weight ($M_B$) | GPC: Sub peak area ($S_B$) ratio (%)/Main peak area ($S_A$) ratio (%) | Coverage ratio A (%) | Coverage ratio B (%) | B/A | Coefficient of variation on coverage ratio A (%) |
|---|---|---|---|---|---|---|---|---|---|---|---|---|
| 13 | 10 | 73.8 | 136.5 | 68.2 | 55.6 | $1.2 \times 10^4$ | $5.2 \times 10^5$ | 32/68 | 56.3 | 37.7 | 0.67 | 9.7 |
| 14 | 10 | 73.7 | 136.1 | 68.0 | 55.5 | $1.2 \times 10^4$ | $5.2 \times 10^5$ | 32/68 | 53.5 | 35.8 | 0.67 | 10.6 |
| 15 | 10 | 73.9 | 137.2 | 68.1 | 55.6 | $1.2 \times 10^4$ | $5.2 \times 10^5$ | 32/68 | 51.5 | 35.0 | 0.68 | 15.5 |
| 16 | 13 | 73.6 | 138.5 | 75.0 | 56.1 | $1.2 \times 10^4$ | $5.1 \times 10^5$ | 32/68 | 56.6 | 37.9 | 0.67 | 12.1 |
| 17 | 14 | 73.2 | 135.6 | 73.4 | 55.7 | $1.1 \times 10^4$ | $5.2 \times 10^5$ | 32/68 | 56.2 | 37.7 | 0.67 | 11.5 |
| 18 | 15 | 73.5 | 140.0 | 86.0 | 55.2 | $1.2 \times 10^4$ | $5.3 \times 10^5$ | 32/68 | 56.4 | 38.4 | 0.68 | 10.4 |
| 19 | 16 | 67.6 | 128.4 | 62.8 | 50.5 | $1.2 \times 10^4$ | $5.2 \times 10^5$ | 32/68 | 56.0 | 38.6 | 0.69 | 10.2 |
| 20 | 17 | 73.8 | 142.8 | 92.4 | 55.4 | $1.2 \times 10^4$ | $5.3 \times 10^5$ | 32/68 | 55.1 | 35.8 | 0.65 | 12.2 |
| 21 | 18 | 63.1 | 128.1 | 55.0 | 49.8 | $1.3 \times 10^4$ | $5.3 \times 10^5$ | 32/68 | 55.6 | 38.4 | 0.69 | 11.4 |
| 22 | 19 | 73.5 | 149.7 | 68.0 | 56.7 | $1.1 \times 10^4$ | $5.1 \times 10^5$ | 40/60 | 55.2 | 37.5 | 0.68 | 11.8 |
| 23 | 20 | 72.6 | 120.1 | 68.3 | 55.4 | $9.7 \times 10^3$ | — | 0/100 | 52.3 | 36.1 | 0.69 | 10.7 |
| 24 | 21 | 60.4 | 125.5 | 55.0 | 44.6 | $4.6 \times 10^3$ | $2.8 \times 10^5$ | 20/80 | 54.3 | 38.0 | 0.70 | 11.2 |
| 25 | 22 | 74.8 | 143.1 | 92.4 | 57.3 | $1.3 \times 10^4$ | $5.2 \times 10^5$ | 32/68 | 56.2 | 37.1 | 0.66 | 10.8 |
| 26 | 22 | 74.9 | 143.9 | 92.8 | 57.5 | $1.3 \times 10^4$ | $5.2 \times 10^5$ | 32/68 | 59.3 | 43.3 | 0.73 | 8.7 |
| 27 | 22 | 74.6 | 142.8 | 92.4 | 57.0 | $1.3 \times 10^4$ | $5.2 \times 10^5$ | 32/68 | 47.2 | 29.7 | 0.63 | 12.3 |
| 28 | 22 | 74.8 | 143.0 | 92.6 | 57.3 | $1.3 \times 10^4$ | $5.2 \times 10^5$ | 32/68 | 50.8 | 35.1 | 0.69 | 10.8 |
| 29 | 22 | 74.7 | 143.2 | 92.6 | 57.4 | $1.3 \times 10^4$ | $5.2 \times 10^5$ | 32/68 | 55.0 | 36.3 | 0.66 | 11.0 |
| 30 | 22 | 74.8 | 143.6 | 92.3 | 57.2 | $1.3 \times 10^4$ | $5.2 \times 10^5$ | 32/68 | 54.5 | 34.9 | 0.64 | 11.2 |
| 31 | 22 | 74.9 | 143.1 | 92.5 | 57.6 | $1.3 \times 10^4$ | $5.2 \times 10^5$ | 32/68 | 54.3 | 34.2 | 0.63 | 11.1 |
| 32 | 22 | 74.6 | 142.5 | 92.6 | 57.3 | $1.3 \times 10^4$ | $5.2 \times 10^5$ | 32/68 | 55.0 | 34.7 | 0.63 | 11.0 |
| 33 | 22 | 74.8 | 143.3 | 92.4 | 57.4 | $1.3 \times 10^4$ | $5.2 \times 10^5$ | 32/68 | 45.7 | 32.0 | 0.70 | 12.2 |
| 34 | 22 | 74.7 | 142.9 | 92.5 | 57.3 | $1.3 \times 10^4$ | $5.2 \times 10^5$ | 32/68 | 47.0 | 31.5 | 0.67 | 11.4 |
| 35 | 22 | 74.6 | 143.4 | 92.3 | 57.0 | $1.3 \times 10^4$ | $5.2 \times 10^5$ | 32/68 | 45.1 | 30.7 | 0.68 | 11.0 |
| 36 | 22 | 74.8 | 143.5 | 92.6 | 57.6 | $1.3 \times 10^4$ | $5.2 \times 10^5$ | 32/68 | 68.9 | 46.9 | 0.68 | 7.7 |
| 37 | 22 | 74.8 | 143.7 | 92.4 | 57.3 | $1.3 \times 10^4$ | $5.2 \times 10^5$ | 32/68 | 69.5 | 43.1 | 0.62 | 8.3 |
| 38 | 22 | 74.7 | 143.0 | 92.5 | 57.4 | $1.3 \times 10^4$ | $5.2 \times 10^5$ | 32/68 | 69.4 | 43.7 | 0.63 | 8.2 |
| 39 | 22 | 74.9 | 144.0 | 92.6 | 57.6 | $1.3 \times 10^4$ | $5.2 \times 10^5$ | 32/68 | 62.3 | 52.3 | 0.84 | 11.8 |
| 40 | 22 | 74.6 | 143.1 | 92.4 | 57.0 | $1.3 \times 10^4$ | $5.2 \times 10^5$ | 32/68 | 64.5 | 35.5 | 0.55 | 12.4 |
| 41 | 22 | 74.8 | 143.6 | 92.3 | 57.1 | $1.3 \times 10^4$ | $5.2 \times 10^5$ | 32/68 | 45.6 | 38.8 | 0.85 | 11.9 |
| 42 | 21 | 60.4 | 125.5 | 55.0 | 44.6 | $4.6 \times 10^3$ | $2.8 \times 10^5$ | 20/80 | 45.2 | 36.2 | 0.80 | 12.3 |
| 43 | 22 | 74.8 | 143.2 | 92.4 | 57.3 | $1.3 \times 10^4$ | $5.2 \times 10^5$ | 32/68 | 45.4 | 24.1 | 0.53 | 11.7 |
| 44 | 21 | 60.1 | 124.9 | 54.7 | 44.5 | $4.6 \times 10^3$ | $2.8 \times 10^5$ | 20/80 | 45.5 | 22.8 | 0.50 | 12.5 |
| 45 | 22 | 74.9 | 143.5 | 92.4 | 57.5 | $1.3 \times 10^4$ | $5.2 \times 10^5$ | 32/68 | 69.0 | 56.6 | 0.82 | 7.8 |
| 46 | 22 | 74.7 | 143.0 | 92.2 | 57.3 | $1.3 \times 10^4$ | $5.2 \times 10^5$ | 32/68 | 68.7 | 35.7 | 0.52 | 7.6 |
| Comparative magnetic toner No. | | | | | | | | | | | | |
| 1 | 1 | 71.2 | 129.3 | 67.9 | 52.1 | $5.8 \times 10^3$ | $2.9 \times 10^5$ | 20/80 | 38.7 | 16.3 | 0.42 | 16.2 |
| 2 | 1 | 71.0 | 129.1 | 67.8 | 52.0 | $5.8 \times 10^3$ | $2.9 \times 10^5$ | 20/80 | 39.5 | 17.0 | 0.43 | 18.2 |
| 3 | 1 | 71.2 | 129.0 | 68.0 | 52.2 | $5.8 \times 10^3$ | $2.9 \times 10^5$ | 20/80 | 49.7 | 17.4 | 0.35 | 13.5 |
| 4 | 1 | 71.1 | 129.5 | 68.1 | 52.1 | $5.8 \times 10^3$ | $2.9 \times 10^5$ | 20/80 | 50.3 | 18.1 | 0.36 | 11.9 |
| 5 | 1 | 71.3 | 129.2 | 68.2 | 52.2 | $5.8 \times 10^3$ | $2.9 \times 10^5$ | 20/80 | 42.0 | 34.4 | 0.82 | 14.6 |
| 6 | 1 | 71.5 | 129.6 | 68.1 | 52.4 | $5.8 \times 10^3$ | $2.9 \times 10^5$ | 20/80 | 44.3 | 37.7 | 0.85 | 13.9 |
| 7 | 29 | 70.3 | 130.1 | 68.0 | 51.2 | $5.8 \times 10^3$ | $2.9 \times 10^5$ | 20/80 | 41.6 | 18.3 | 0.44 | 15.6 |
| 8 | 29 | 70.5 | 131.0 | 68.1 | 51.8 | $5.8 \times 10^3$ | $2.9 \times 10^5$ | 20/80 | 56.8 | 27.3 | 0.48 | 14.3 |
| 9 | 30 | 70.8 | 130.5 | 68.0 | 51.6 | $5.8 \times 10^3$ | $2.9 \times 10^5$ | 20/80 | 64.1 | 57.0 | 0.89 | 13.1 |
| 10 | 30 | 70.7 | 129.3 | 68.2 | 51.4 | $5.8 \times 10^3$ | $2.9 \times 10^5$ | 20/80 | 72.7 | 61.1 | 0.84 | 13.2 |
| 11 | 1 | 71.4 | 129.4 | 68.0 | 52.2 | $5.8 \times 10^3$ | $2.9 \times 10^5$ | 20/80 | 56.8 | 34.1 | 0.60 | 7.1 |
| 12 | 1 | 71.3 | 129.0 | 67.7 | 52.0 | $5.8 \times 10^3$ | $2.9 \times 10^5$ | 20/80 | 53.4 | 33.6 | 0.63 | 8.2 |
| 13 | 1 | 71.2 | 128.9 | 67.9 | 52.1 | $5.8 \times 10^3$ | $2.9 \times 10^5$ | 20/80 | 46.2 | 22.2 | 0.48 | 13.4 |
| 14 | 1 | 71.0 | 129.2 | 68.2 | 51.9 | $5.8 \times 10^3$ | $2.9 \times 10^5$ | 20/80 | 42.2 | 21.9 | 0.52 | 14.0 |
| 15 | 1 | 71.6 | 129.8 | 68.1 | 52.4 | $5.8 \times 10^3$ | $2.9 \times 10^5$ | 20/80 | 73.4 | 41.1 | 0.56 | 6.5 |
| 16 | 1 | 71.4 | 129.7 | 68.0 | 52.2 | $5.8 \times 10^3$ | $2.9 \times 10^5$ | 20/80 | 65.9 | 31.0 | 0.47 | 12.4 |
| 17 | 1 | 71.5 | 129.5 | 68.1 | 52.3 | $5.8 \times 10^3$ | $2.9 \times 10^5$ | 20/80 | 48.0 | 42.2 | 0.88 | 13.3 |
| 18 | 1 | 71.2 | 129.3 | 68.0 | 52.0 | $5.8 \times 10^3$ | $2.9 \times 10^5$ | 20/80 | 35.0 | 17.9 | 0.51 | 15.2 |
| 19 | 23 | 72.4 | 132.1 | 80.3 | 52.4 | $5.9 \times 10^3$ | $2.9 \times 10^5$ | 20/80 | 60.1 | 37.9 | 0.63 | 6.8 |
| 20 | 24 | 75.1 | 126.6 | 69.1 | 61.1 | $1.3 \times 10^4$ | $2.9 \times 10^5$ | 20/80 | 57.1 | 32.0 | 0.56 | 6.7 |
| 21 | 25 | 75.3 | 131.8 | 92.6 | 60.0 | $1.4 \times 10^4$ | $2.8 \times 10^5$ | 20/80 | 60.3 | 38.6 | 0.64 | 7.6 |
| 22 | 26 | 59.1 | 125.5 | 43.5 | 43.3 | $4.6 \times 10^3$ | $2.9 \times 10^5$ | 20/80 | 55.6 | 29.5 | 0.53 | 6.4 |
| 23 | 27 | 72.1 | 157.5 | 68.1 | 54.1 | $5.7 \times 10^3$ | $5.3 \times 10^5$ | 45/55 | 57.9 | 35.3 | 0.61 | 7.2 |
| 24 | 28 | 69.8 | 118.6 | 68.2 | 52.1 | $6.0 \times 10^3$ | — | 0/100 | 62.1 | 42.2 | 0.68 | 8.0 |

Example 1

The evaluations described below were performed using magnetic toner 1.

The image-forming apparatus was an LBP-3100 (Canon, Inc.), which was equipped with a film fixing unit in which the fixing member was composed of a film; the temperature of the film fixing unit could be varied and the printing speed had been modified from 16 sheets/minute to 20 sheets/minute.

In the test of the low-temperature fixability, the evaluation was performed in a low-temperature, low-humidity environment (7.5° C., 10% RH) and FOX RIVER BOND paper (75 g/m$^2$) was used for the fixing media.

The fixing performance can be rigorously evaluated by setting up conditions unfavorable to heat transfer during fixing by lowering the temperature of the surrounding environment during fixing as above in order to lower the paper temperature of the media and by setting up rubbing conditions by using a media in which the media itself has a relatively large surface unevenness.

The evaluation methods and associated scales used in the evaluations carried out in the examples of the present invention and comparative examples are described below. The results of the evaluations are given in Table 8.

<Low-Temperature Fixability>

For the low-temperature fixability, images were output on FOX RIVER BOND paper at a set temperature of 200° C. while adjusting the halftone image density to provide an image density, as measured with a MacBeth reflection densitometer (MacBeth Corporation), of from at least 0.75 to not more than 0.80.

After this, printing was carried out with the set temperature at the fixing unit lowered in 5° C. decrements from 210° C. The fixed image was then rubbed ten times with lens-cleaning paper placed under a load of 55 g/cm$^2$, and the fixing lower-limit temperature was taken to be the temperature at which the decline in the density of the fixed image after rubbing exceeded 10%. A lower value for this temperature indicates a toner having a better low-temperature fixability. The scale for scoring this evaluation is given below.

A: less than 160° C.
B: from at least 160° C. to less than 170° C.
C: from at least 170° C. to less than 185° C.
D: from at least 185° C. to less than 200° C.
E: at least 200° C.

<Hot Offset>

In the hot offset evaluation, a halftone image of height 2.0 cm and width 15.0 cm was formed at normal temperature and normal humidity (25° C., 50% RH) in the region 2.0 cm from the upper edge and the region 2.0 cm from the lower edge, considered in the direction of paper travel, on 90 g/m$^2$ A4 paper. Image output was performed while carrying out adjustment such that the image density, as measured with a MacBeth reflection densitometer (MacBeth Corporation), was from at least 0.75 to not more than 0.80. The image output was performed by raising the set temperature at the fixing unit in 5° C. increments from 180° C. The evaluation was performed by visual inspection and was scored on the following scale.

A: hot offset was not produced up to 210° C.
B: hot offset was produced at less than 210° C. and greater than or equal to 200° C.
C: hot offset was produced at less than 200° C. and greater than or equal to 190° C.
D: hot offset was produced at less than 190° C.

<Storage Stability>

For the storage stability test, a solid image was output in a high-temperature, high-humidity environment (32.5° C., 80% RH) followed by storage of the developing assembly in a severe environment (45° C., 90% RH) for 30 days. After this storage, a solid image was output in a high-temperature, high-humidity environment (32.5° C., 80% RH), and a comparative evaluation was performed of the pre- and post-storage image densities. The density of the solid image was measured with a MacBeth reflection densitometer (MacBeth Corporation).

A: the pre-versus-post-storage density difference is less than 0.05
B: the pre-versus-post-storage density difference is less than 0.10 and greater than or equal to 0.05
C: the pre-versus-post-storage density difference is less than 0.20 and greater than or equal to 0.10
D: the pre-versus-post-storage density difference is less than 0.30 and greater than or equal to 0.20
E: the pre-versus-post-storage density difference is greater than or equal to 0.30

Examples 2 to 46

The same image output testing was performed as in Example 1, but using magnetic toners 2 to 46. According to the results, images were obtained with all the magnetic toners that were at least a practically unproblematic level both pre- and post-durability testing. The results of the evaluations are shown in Table 8.

Comparative Examples 1 to 24

The same image output testing was performed as in Example 1, but using comparative magnetic toners 1 to 24. According to the results, with all of these toners either the low-temperature fixability or the storage stability or both the low-temperature fixability and the storage stability were poor. The results of the evaluations are shown in Table 8.

TABLE 8

| Magnetic toner No. | Low-temperature fixability | Hot offset | Pre-storage density | Post-storage density | Density difference |
|---|---|---|---|---|---|
| 1 | A (150° C.) | A (210° C.) | 1.51 | 1.50 | A (0.01) |
| 2 | A (150° C.) | A (210° C.) | 1.51 | 1.48 | A (0.03) |
| 3 | A (150° C.) | A (210° C.) | 1.50 | 1.47 | A (0.03) |
| 4 | A (155° C.) | A (210° C.) | 1.52 | 1.48 | A (0.04) |
| 5 | A (155° C.) | A (210° C.) | 1.50 | 1.48 | A (0.02) |
| 6 | B (160° C.) | A (210° C.) | 1.49 | 1.47 | A (0.02) |
| 7 | B (160° C.) | A (210° C.) | 1.51 | 1.48 | A (0.03) |
| 8 | B (160° C.) | A (210° C.) | 1.51 | 1.47 | A (0.04) |
| 9 | B (165° C.) | A (210° C.) | 1.50 | 1.48 | A (0.02) |
| 10 | B (165° C.) | A (210° C.) | 1.50 | 1.48 | A (0.02) |
| 11 | A (155° C.) | B (205° C.) | 1.49 | 1.44 | B (0.05) |
| 12 | A (150° C.) | B (200° C.) | 1.48 | 1.34 | C (0.14) |
| 13 | B (165° C.) | A (210° C.) | 1.50 | 1.46 | A (0.04) |
| 14 | C (170° C.) | A (210° C.) | 1.50 | 1.44 | B (0.06) |
| 15 | C (175° C.) | A (210° C.) | 1.47 | 1.35 | C (0.12) |
| 16 | C (170° C.) | A (210° C.) | 1.48 | 1.41 | B (0.07) |
| 17 | C (170° C.) | A (210° C.) | 1.48 | 1.41 | B (0.07) |
| 18 | C (170° C.) | A (210° C.) | 1.49 | 1.43 | B (0.05) |
| 19 | B (165° C.) | A (215° C.) | 1.47 | 1.38 | B (0.09) |
| 20 | C (175° C.) | A (215° C.) | 1.51 | 1.46 | B (0.05) |
| 21 | B (160° C.) | B (205° C.) | 1.47 | 1.33 | C (0.14) |
| 22 | C (175° C.) | A (215° C.) | 1.49 | 1.44 | B (0.05) |
| 23 | B (165° C.) | C (195° C.) | 1.49 | 1.40 | B (0.09) |
| 24 | B (160° C.) | B (200° C.) | 1.48 | 1.36 | C (0.15) |
| 25 | C (175° C.) | A (215° C.) | 1.49 | 1.42 | B (0.07) |
| 26 | C (175° C.) | A (215° C.) | 1.49 | 1.43 | B (0.06) |
| 27 | C (175° C.) | A (215° C.) | 1.48 | 1.36 | C (0.12) |
| 28 | C (175° C.) | A (215° C.) | 1.49 | 1.43 | B (0.06) |
| 29 | C (175° C.) | A (215° C.) | 1.49 | 1.42 | B (0.07) |
| 30 | C (175° C.) | A (215° C.) | 1.49 | 1.43 | B (0.06) |

TABLE 8-continued

| | | | | | |
|---|---|---|---|---|---|
| 31 | C (175° C.) | A (215° C.) | 1.49 | 1.43 | B (0.06) |
| 32 | C (175° C.) | A (215° C.) | 1.48 | 1.42 | B (0.06) |
| 33 | C (175° C.) | B (205° C.) | 1.48 | 1.38 | C (0.10) |
| 34 | C (175° C.) | B (205° C.) | 1.48 | 1.36 | C (0.12) |
| 35 | C (175° C.) | B (205° C.) | 1.47 | 1.35 | C (0.12) |
| 36 | C (175° C.) | A (215° C.) | 1.49 | 1.44 | B (0.05) |
| 37 | C (180° C.) | A (215° C.) | 1.48 | 1.43 | B (0.05) |
| 38 | C (180° C.) | A (215° C.) | 1.47 | 1.41 | B (0.06) |
| 39 | C (175° C.) | A (215° C.) | 1.50 | 1.44 | B (0.06) |
| 40 | C (175° C.) | A (215° C.) | 1.50 | 1.43 | B (0.07) |
| 41 | C (180° C.) | A (210° C.) | 1.48 | 1.36 | C (0.12) |
| 42 | B (165° C.) | C (190° C.) | 1.47 | 1.30 | C (0.17) |
| 43 | C (180° C.) | A (210° C.) | 1.49 | 1.36 | C (0.13) |
| 44 | B (165° C.) | C (190° C.) | 1.48 | 1.30 | C (0.18) |
| 45 | C (180° C.) | A (210° C.) | 1.48 | 1.42 | B (0.06) |
| 46 | C (180° C.) | A (210° C.) | 1.48 | 1.43 | B (0.05) |

| Comparative magnetic toner No. | Low-temperature fixability | Hot offset | Pre-storage density | Post-storage density | Density difference |
|---|---|---|---|---|---|
| 1 | D (185° C.) | C (195° C.) | 1.46 | 1.22 | D (0.24) |
| 2 | D (185° C.) | C (195° C.) | 1.46 | 1.21 | D (0.25) |
| 3 | D (185° C.) | B (200° C.) | 1.47 | 1.25 | D (0.22) |
| 4 | D (185° C.) | B (200° C.) | 1.47 | 1.28 | C (0.19) |
| 5 | C (180° C.) | B (200° C.) | 1.48 | 1.27 | D (0.21) |
| 6 | C (180° C.) | B (200° C.) | 1.46 | 1.22 | D (0.24) |
| 7 | D (195° C.) | C (195° C.) | 1.46 | 1.26 | D (0.20) |
| 8 | D (190° C.) | B (200° C.) | 1.45 | 1.26 | C (0.19) |
| 9 | D (195° C.) | B (200° C.) | 1.46 | 1.39 | B (0.07) |
| 10 | E (200° C.) | B (200° C.) | 1.43 | 1.37 | B (0.06) |
| 11 | D (185° C.) | B (200° C.) | 1.47 | 1.35 | C (0.12) |
| 12 | D (185° C.) | B (200° C.) | 1.47 | 1.38 | B (0.09) |
| 13 | D (185° C.) | C (195° C.) | 1.46 | 1.26 | C (0.16) |
| 14 | D (185° C.) | C (195° C.) | 1.47 | 1.26 | D (0.21) |
| 15 | E (200° C.) | B (200° C.) | 1.46 | 1.42 | A (0.04) |
| 16 | D (185° C.) | B (200° C.) | 1.48 | 1.36 | C (0.12) |
| 17 | D (185° C.) | B (200° C.) | 1.48 | 1.31 | C (0.17) |
| 18 | E (200° C.) | B (205° C.) | 1.48 | 1.26 | D (0.22) |
| 19 | D (185° C.) | B (200° C.) | 1.49 | 1.46 | A (0.03) |
| 20 | D (185° C.) | C (195° C.) | 1.47 | 1.43 | A (0.04) |
| 21 | E (200° C.) | B (205° C.) | 1.50 | 1.47 | A (0.03) |
| 22 | C (170° C.) | C (190° C.) | 1.48 | 1.16 | E (0.32) |
| 23 | E (205° C.) | A (210° C.) | 1.48 | 1.46 | A (0.02) |
| 24 | C (170° C.) | D (185° C.) | 1.47 | 1.42 | B (0.05) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-019519, filed on Feb. 1, 2012, which is hereby incorporated by reference herein in its entirety.

REFERENCE SIGNS LIST

1: main casing
2: rotating member
3, 3*a*, 3*b*: stirring member
4: jacket
5: raw material inlet port
6: product discharge port
7: center shaft
8: drive member
9: processing space
10: end surface of the rotating member
11: direction of rotation
12: back direction
13: forward direction
16: raw material inlet port inner piece
17: product discharge port inner piece
d: distance showing the overlapping portion of the stirring members
D: stirring member width
51, 54: heating body
52: heater substrate
53: heating element
55: heat-resistant film
56, 57: belt support roller
58: support roller
100: electrostatic latent image-bearing member (photosensitive member)
102: toner-carrying member (developing sleeve)
103: developing blade
114: transfer member (transfer roller)
116: cleaner
117: charging member (charging roller)
121: laser generator (latent image-forming means, photo-exposure apparatus)
123: laser
124: register roller
125: transport belt
126: fixing unit
140: developing device
141: stirring member

The invention claimed is:

1. A magnetic toner comprising:
magnetic toner particles comprising a binder resin, a magnetic body, and a release agent; and
inorganic fine particles present on the surface of the magnetic toner particles,
wherein;
the inorganic fine particles present on the surface of the magnetic toner particles comprise metal oxide fine particles,
the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles,
wherein;
when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed on the magnetic toner particles' surface,
the magnetic toner has a coverage ratio A of at least 45.0% and not more than 70.0% and a ratio [coverage ratio B/coverage ratio A] of the coverage ratio B to the coverage ratio A of at least 0.50 and not more than 0.85,
wherein
the binder resin comprises a styrene resin,
the release agent comprises a monoester compound or a diester compound,
and wherein
in measurement of the magnetic toner with a constant-load extrusion-type capillary rheometer, a softening temperature (Ts) is from at least 60.0° C. to not more than 75.0° C. and a softening point (Tm) is from at least 120.0° C. to not more than 150.0° C.

2. The magnetic toner according to claim 1, wherein an endothermic peak is present from at least 60° C. to not more than 90° C. when the magnetic toner is measured with a differential scanning calorimeter.

3. The magnetic toner according to claim 1, wherein the coefficient of variation on the coverage ratio A is not more than 10.0.

4. The magnetic toner according to claim 1, wherein the glass-transition temperature of the magnetic toner is from at least 45° C. to not more than 55° C.

5. The magnetic toner according to claim 1, wherein in a molecular weight distribution of the tetrahydrofuran (THF)-soluble matter of the magnetic toner as measured by gel permeation chromatography (GPC), a main peak ($M_A$) is present in a range from a molecular weight of at least $5\times10^3$ to not more than $1\times10^4$, a sub peak ($M_B$) is present in a range from a molecular weight of at least $1\times10^5$ to not more than $5\times10^5$, and a ratio $[S_A/(S_A+S_B)]$ of the main peak area ($S_A$) to the sum total area of the main peak area and the sub peak area ($S_B$) is at least 70%.

* * * * *